US008141202B2

(12) United States Patent
Hawkins et al.

(10) Patent No.: US 8,141,202 B2
(45) Date of Patent: Mar. 27, 2012

(54) VACUUM CLEANER DIRT RECEPTACLE AND EXHAUST FILTER COVER

(75) Inventors: Thomas W. Hawkins, Normal, IL (US); Gregory W. Luebbering, Heyworth, IL (US); Richard J. Eisenmenger, Champaign, IL (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 476 days.

(21) Appl. No.: 11/938,505

(22) Filed: Nov. 12, 2007

(65) Prior Publication Data

US 2008/0127450 A1 Jun. 5, 2008

(51) Int. Cl.
*A47L 9/04* (2006.01)

(52) U.S. Cl. ..... 15/352; 15/357; 15/377; 15/389; 15/50.3; 15/351

(58) Field of Classification Search ..... 15/352, 15/357, 377, 389, 50.3, 327.1–327.7, 351, 15/391

See application file for complete search history.

(56) References Cited

U.S. PATENT DOCUMENTS

| | | | | |
|---|---|---|---|---|
| 2,591,214 | A | | 4/1952 | Tamarin |
| 2,633,596 | A | | 4/1953 | Turner et al. |
| 3,011,033 | A | | 11/1961 | Belilcka et al. |
| 3,300,806 | A | | 1/1967 | Ripple |
| 3,550,182 | A | | 12/1970 | Kivela |
| 3,929,210 | A | | 12/1975 | Cutler et al. |
| 4,141,438 | A | | 2/1979 | Diem |
| 4,592,764 | A | | 6/1986 | Ikezaki et al. |
| 4,701,974 | A | | 10/1987 | Konig et al. |
| 4,709,443 | A | * | 12/1987 | Bigley ..... 15/339 |
| 4,713,497 | A | | 12/1987 | Smith |
| 4,905,341 | A | | 3/1990 | Sunagawa et al. |
| 5,135,181 | A | | 8/1992 | Wesselink |
| 5,168,598 | A | | 12/1992 | Hashizume et al. |
| 5,255,768 | A | | 10/1993 | Kasper et al. |
| 5,500,979 | A | | 3/1996 | Worwag |
| 5,524,321 | A | | 6/1996 | Weaver et al. |
| 5,622,243 | A | | 4/1997 | Kang |
| D379,692 | S | | 6/1997 | Abe |

(Continued)

FOREIGN PATENT DOCUMENTS

| | | |
|---|---|---|
| DE | 616857 | 8/1935 |

(Continued)

OTHER PUBLICATIONS

Three Photographs of Eureka "Excalibur" Vacuum.

(Continued)

*Primary Examiner* — Robert Scruggs
(74) *Attorney, Agent, or Firm* — Hunton & Williams

(57) ABSTRACT

A vacuum cleaner housing member having a rigid frame, a grate and a flexible cover. The rigid frame has an outer perimeter and an opening therethrough. The grate is mounted in the opening and has an inner surface, an outer surface, one or more air passages extending from the inner surface to the outer surface, and an outer perimeter wall defining the peripheral edge of the grate. The flexible cover extends over at least one of the one or more air passages and is positioned over at least a portion of the outer surface, extends around at least a portion of the outer perimeter wall, and is positioned over at least a portion of the inner surface. A vacuum cleaner including the housing members similar to the foregoing member is also provided.

21 Claims, 20 Drawing Sheets

U.S. PATENT DOCUMENTS

| | | | | |
|---|---|---|---|---|
| 5,672,642 | A | 9/1997 | Gros | |
| 5,715,566 | A * | 2/1998 | Weaver et al. | 15/320 |
| 5,725,623 | A * | 3/1998 | Bowerman et al. | 55/490 |
| 5,863,309 | A | 1/1999 | Louis et al. | |
| 5,867,863 | A | 2/1999 | McCormick | |
| 5,937,476 | A | 8/1999 | Kim | |
| 5,950,272 | A | 9/1999 | Kim et al. | |
| 5,961,676 | A | 10/1999 | King et al. | |
| 6,035,486 | A * | 3/2000 | McCormick | 15/352 |
| 6,052,862 | A | 4/2000 | Lowery | |
| 6,237,188 | B1 | 5/2001 | Takemoto et al. | |
| 6,314,610 | B1 * | 11/2001 | Miller et al. | 15/347 |
| 6,349,808 | B1 | 2/2002 | Bryant | |
| 6,588,051 | B2 | 7/2003 | Hashizume et al. | |
| 6,609,270 | B2 | 8/2003 | Kim | |
| 6,626,390 | B2 | 9/2003 | Albert et al. | |
| 6,779,229 | B2 | 8/2004 | Lee et al. | |
| 7,284,298 | B2 | 10/2007 | Stein | |
| 2004/0088819 | A1 * | 5/2004 | Hafling et al. | 15/347 |

FOREIGN PATENT DOCUMENTS

| | | |
|---|---|---|
| DE | 21 24 790 | 3/1972 |
| DE | 27 24 249 | 11/1978 |
| GB | 1 072 791 | 6/1967 |

OTHER PUBLICATIONS

Panasonic MC-6815/MC-6855 Brochure.
Undated—admitted prior art.

* cited by examiner 2404
1501
2511
2513
2511
2401
2515
2572
2504
2522
2518
2509
2517
2408
2505
2520
2507
2521
2503
2510
2510
2502
2523
2502
2516
2514
2519
2525
2501
2524
2508
2506
2526
2407
2402
2403

VACUUM CLEANER DIRT RECEPTACLE AND EXHAUST FILTER COVER

FIELD OF THE INVENTION

The present invention relates to upright vacuum cleaners.

BACKGROUND

Vacuum cleaning devices, such as upright and canister vacuum cleaners, wet extractors, stick vacuums, electric brooms and other devices, are in widespread use as a tool to clean floors, upholstery, stairs, and other surfaces.

Known vacuum cleaning devices have various features that are intended to improve their cleaning effectiveness. For example, a common feature on upright vacuums is a rotating brushroll, and numerous variations on such brushrolls are known in the art. Another feature is the provision of various types of filtration systems, such as vacuum bags, disposable or reusable filters, cyclone separators, and combinations thereof. Still other features relate to controlling the manner in which the vacuum cleaner addresses the surface being cleaned, such as nozzle height adjustment mechanisms.

Known vacuum cleaning devices are also provided with various features that are directed towards improving user convenience and overall ease of use. For example, various types of accessory tool storage arrangements have been provided, as have retractable cordreels. Still other features have been provided to reduce the noise level of the cleaning device to reduce potential irritation caused thereby.

While the prior art provides various features relating to cleaning effectiveness and user convenience, there still exists a need for improvement in these and other features of vacuum cleaning devices.

SUMMARY OF THE INVENTION

In a first aspect, the present invention provides a motor and brushroll mounting system for a cleaning device. The mounting system includes a motor, an agitator, a drive system, and a bracket. The motor has a rotary driving component adapted to rotate about a drive axis centerline, and a motor housing. The agitator has a rotary member having a driven component and at least one agitator, and at least one fixed member. The rotary member is rotatably held by the fixed member such that it is rotatable about a driven axis centerline. The drive system operatively connects the driving component and the driven component. The bracket is attached at a first end to the motor housing and at the second end to the at least one fixed member, and extends substantially directly therebetween to substantially prevent relative translation between the drive axis centerline and the driven axis centerline.

In a second aspect, the present invention provides a nozzle for a cleaning device. The nozzle has a housing, an inlet forming an air flow path into the housing, and an agitator chamber adjacent the inlet. The nozzle also has an agitator, a motor, a drive system, and an alignment bracket. The agitator includes a rotary member disposed at least partially within the agitator chamber and having an agitator rotary axis, and a fixed member adapted to pivotally hold the rotary member. The motor is disposed within the housing and has a motor rotary axis. The drive system operatively connects the motor and the rotary member. The alignment bracket mechanically attaches the fixed member to the motor to substantially prevent relative translation between the agitator rotary axis and the motor rotary axis.

In a third aspect, the present invention provides an alignment bracket for cleaning device agitators. The alignment bracket includes a first portion that is adapted to rigidly attach to a motor that is contained in a housing, a second portion that is adapted to rigidly attach to an agitator mount that is contained in a housing, and a third portion extending between the first portion and the second portion. The alignment bracket is separate from the housing that contains the motor and the agitator, and is substantially more rigid than the portion of the housing located between an output shaft of the motor and the agitator mount.

BRIEF DESCRIPTION OF THE DRAWINGS

The present invention is described in detail with reference to the examples of preferred embodiments shown in the following figures, in which like parts are designated by like reference numerals.

DETAILED DESCRIPTION OF PREFERRED EMBODIMENTS

Figure 1:
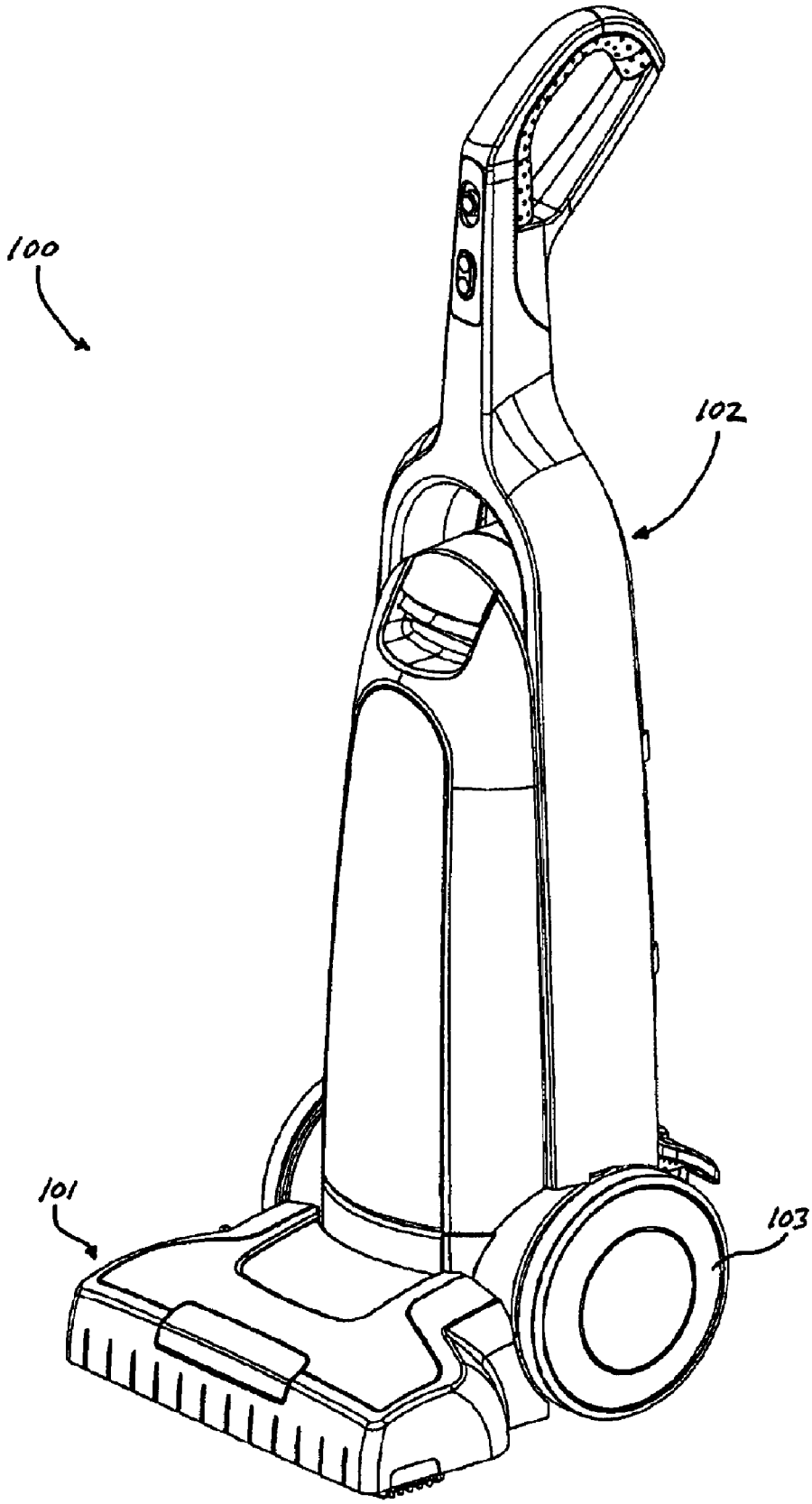
FIG. 1 is a front isometric view of an embodiment of a vacuum cleaner of the present invention.
Figure 2:
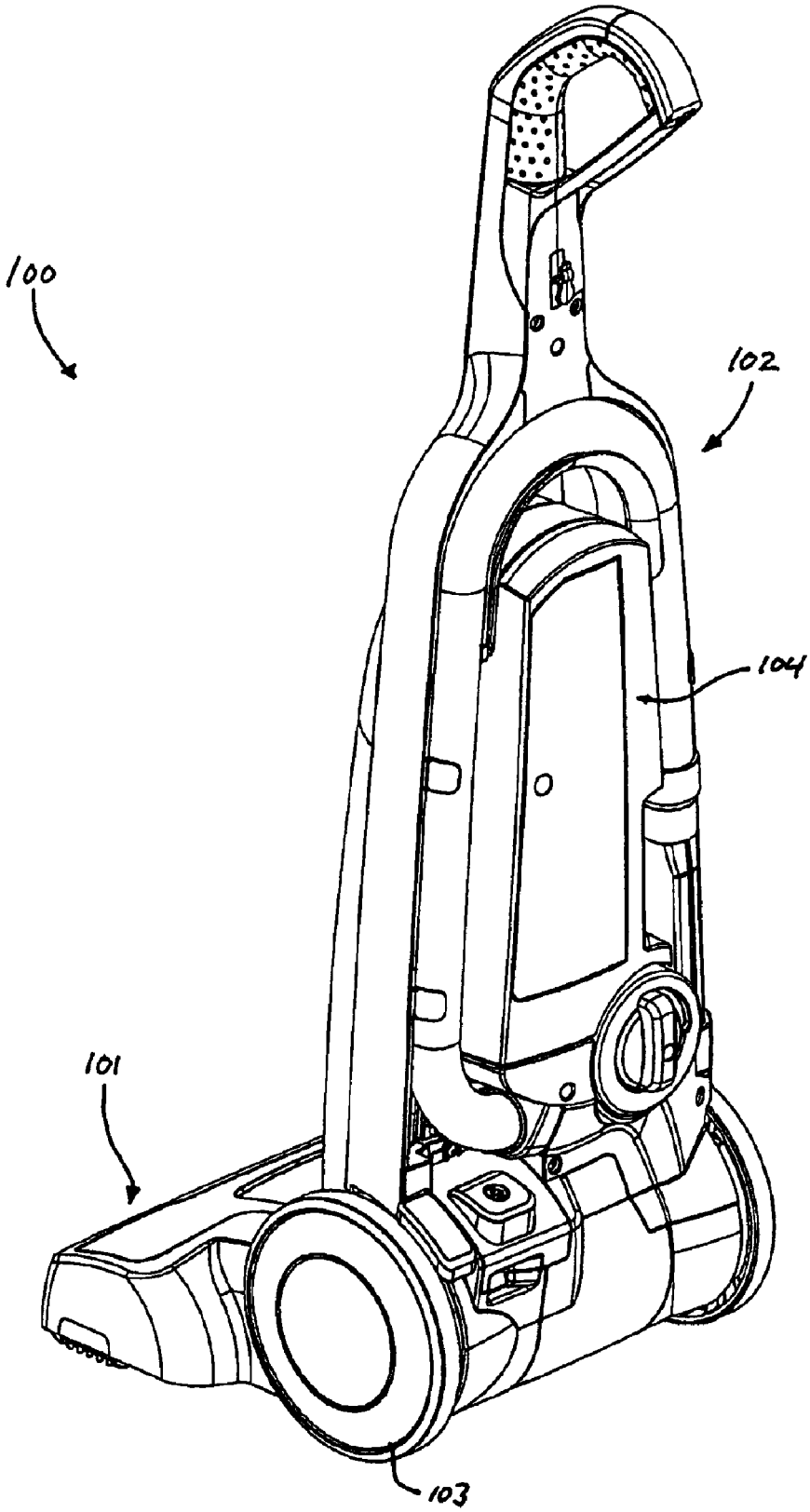
FIG. 2 is a rear isometric view of the embodiment of FIG. 1.
Figure 3:
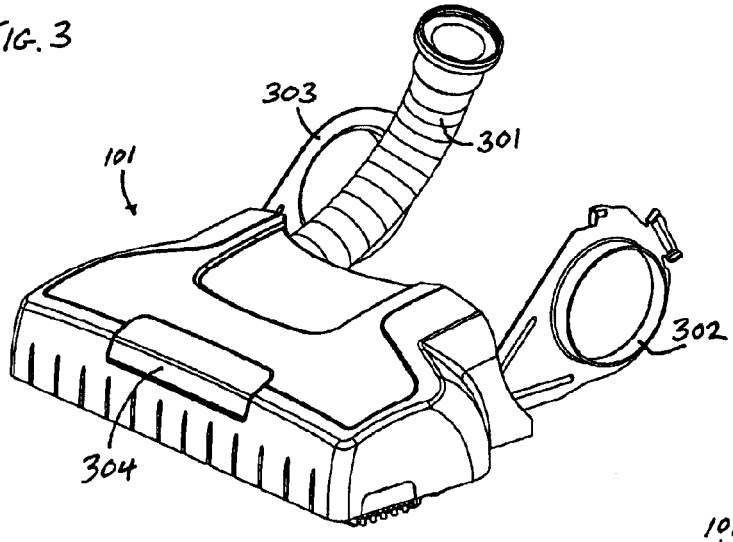
FIGS. 3 through 5 are various views of the base of the embodiment of FIG. 1.
Figure 4:
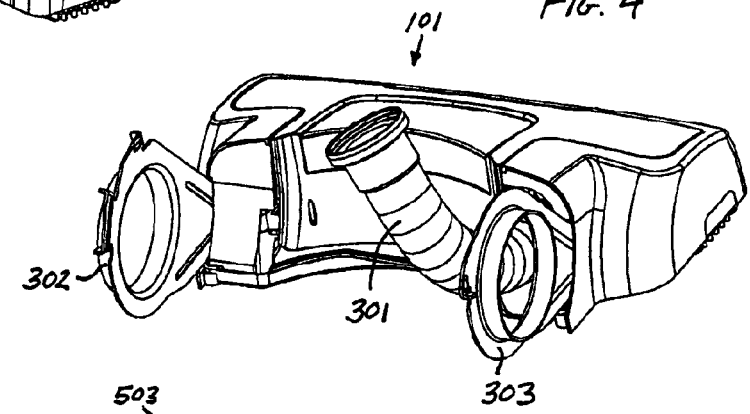

Referring now to FIGS. 1 and 2, the present invention provides an upright vacuum cleaner 100 having various inventive features. It will be appreciated that, while the preferred embodiment is described and illustrated with reference to an upright vacuum cleaner having a bag-type dirt receptacle, the various features of the invention may be used with any type of cleaning device, such as cyclonic vacuums, canister vacuums, stick vacuums, wet and dry powder extractors, handheld vacuums, and so on.

Figure 5:
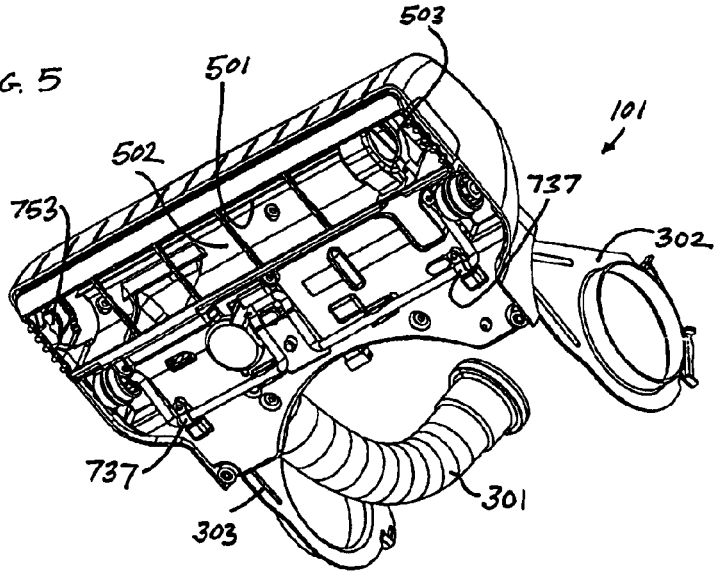

The vacuum cleaner 100 generally comprises a base 101 to which a rear housing 102 is pivotally attached. The base 101 includes a downward-facing, floor-engaging vacuum inlet nozzle opening 501 (FIG. 5). The rear housing 102 comprises a generally vertically-extending structure that can be tilted backwards, as explained elsewhere herein, to guide the base 101 across a surface being cleaned. A pair of wheels 103 are affixed to the rear housing 102 (or the base 101) to facilitate movement of the device. The various working parts of the vacuum cleaner 100 are installed in or on either the base 101 or rear housing 102. While the description herein provides preferred locations for such parts in either the base 101 or rear housing 102, it will be understood that these locations are generally interchangeable.

Referring now to FIGS. 3-9, an embodiment of the vacuum base 101 is illustrated and described in greater detail. The base 101 generally comprises a base frame 600 to which a base subhousing 601 (FIG. 6), furniture guard 602, hood 603, lower display cover 604 and base hose 301 are attached. Left and right mounting brackets 302, 303 are also mounted to the base frame 600. Screws, snaps or other suitable fasteners may be used to assemble these parts together.

The base frame 600 comprises a molded plastic part to which the various working parts of the base 101, are mounted. While the base frame 600 and various other components of the invention are described as plastic moldings or as being made with particular materials or in particular ways, it will be understood that other materials or construction techniques can be used. For example, metal stampings or other constructions may be used. As such, the base frame 600 and other parts of the invention are not limited to the materials and constructions described herein, and the described parts are to be viewed as exemplary embodiments of suitable materials and constructions, which may be modified as understood by those of ordinary skill in the art. The base frame 600 is described in more detail later herein.

The base subhousing 601 comprises molded plastic part that fits over the base frame 600. A clear headlight lens 304 is attached to (or formed integrally with) the base subhousing 601, and positioned to overlie a headlight assembly 605, which is described in detail elsewhere herein. The headlight lens 304 may be a simple clear plastic part, or it may be shaped to provide light diffusion or focusing characteristics for the headlight assembly 605. For example, the headlight lens 304 may be provided with fresnel lens surfaces to focus the light from the headlight assembly 605.

The furniture guard 602 comprises a molded plastic part that fits over the base subhousing 601 and base frame 600. The furniture guard 602 has a skirt-like periphery 606 that extends around the front and sides of the base subhousing 601 and base frame 600 to conceal these parts and provide a pleasing outer appearance. The furniture guard 602 may also include overmolded or molded-in-place, non-marking, rubber bumpers located around its periphery 606 to help prevent the base 101 from scuffing or otherwise damaging furniture, baseboards, walls, or other surfaces that it may contact during use.

The hood 603 is mounted to the upper portion of the furniture guard 602, and covers the interior of the base 101. The hood 603 includes a depressed portion that forms a display housing 607. A lower display board 608 is installed in the display housing 607 by screws (not shown) or other fastening means, such at snap-fit tabs. The display housing 607 includes a passage (not shown) that allows wired to pass to the lower display board 608. The features and function of the lower display board 608 are described in detail elsewhere herein. The use of a separate hood 603 and furniture guard 602, rather than molding the same as part of the furniture guard 602, provides the opportunity to form the base 101 with multiple differently-colored parts to provide a pleasing aesthetic appearance, but is not required.

The lower display cover 604 covers the display housing 607 portion of the hood 603. The lower display cover 604 preferably comprises a clear plastic part that snaps into place by the use of tabs 609, screws, or other fitment means. In one embodiment, the entire lower display cover 604 is clear, but in other embodiments, only the portion of the lower display cover 604 that overlies the lower display board 608 is clear. As with the headlight lens 304, the lower display cover 604 may form a simple, flat window, or it may be shaped to provide light diffusion or focusing characteristics for the lower display board 608.

The base hose 301 comprises a flexible hose having a hose connector 610 at its distal end (the end remote from the base 101, when assembled), and a inlet nozzle adapter 611 at its proximal end. When the vacuum cleaner 100 is assembled, the base hose 301 passes through a hose slot 1601 in the rear housing 102 (FIG. 16), and attaches to a floor inlet 2402 on an accessory valve 1501, as described in more detail elsewhere herein. The inlet nozzle adapter 611 comprises a generally square flange (although other shapes may be used) that slides into a corresponding slot 612 on the base frame 600. The nozzle adapter 611 is held in place by snap fittings or screws, or may be captured by other parts, such as the base subhousing 601 and/or furniture guard 602. As shown most clearly in FIG. 5, when installed, the nozzle adapter 611 is located adjacent a brushroll chamber 502 that is formed in the lower surface of the base frame 600. The brushroll 701 (FIGS. 7, 10 and 12) is omitted from FIG. 5 to clarify this feature.

Figure 7:
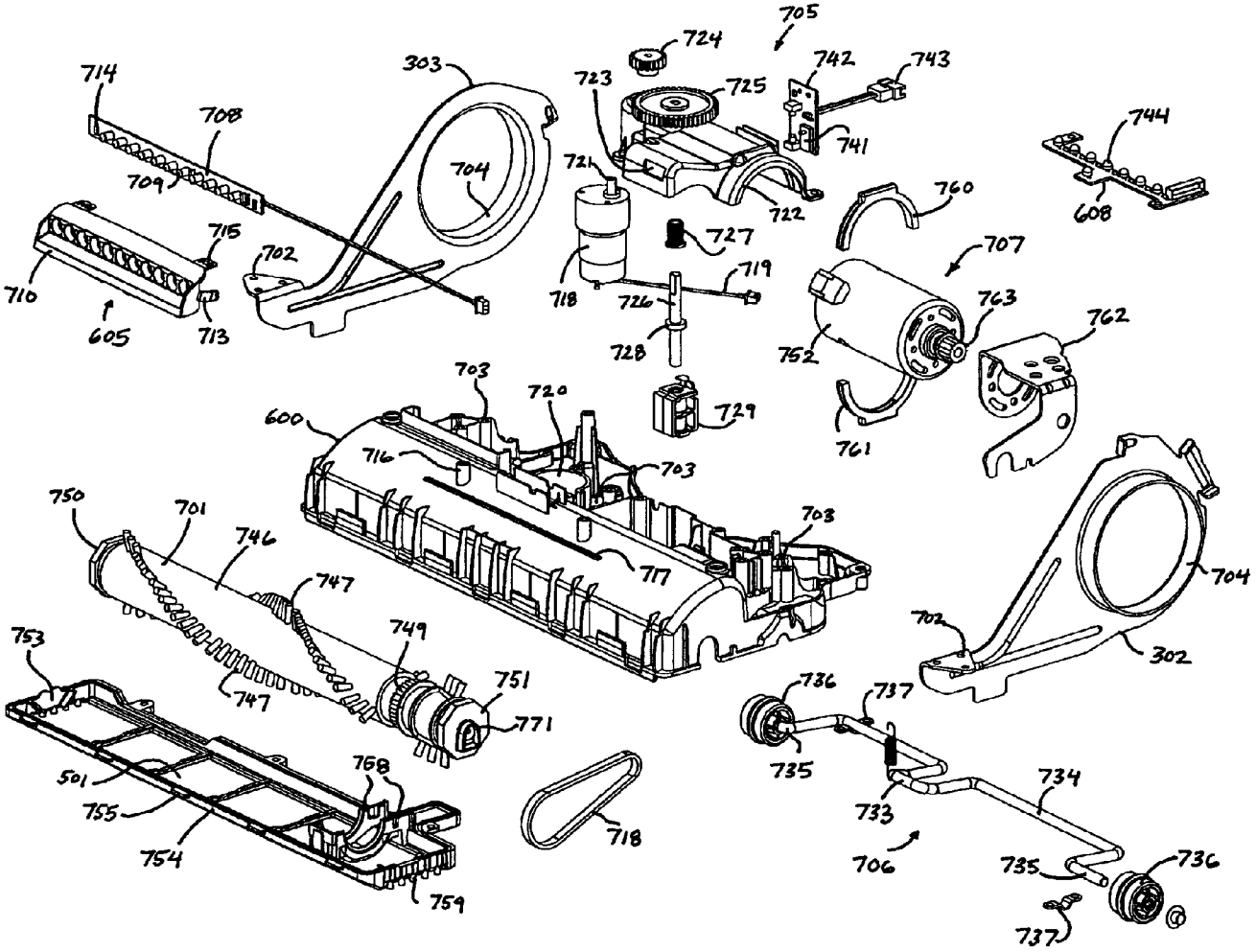
FIG. 7 is a further exploded view of the base of the embodiment of FIG. 1.

The mounting brackets 302, 303 are preferably constructed as stamped or cast metal parts, such as steel stampings, so that they can have the slimmest possible profile while still being strong enough to form a pivoting joint between the base 101 and the rear housing 102. Of course, other suitable materials may be used, and it is not strictly necessary to minimize the size of the brackets 302, 303. Each mounting bracket 302, 303 is attached to the base frame 600 by three screws (not shown). As shown in FIG. 7, the screws pass through a triangular pattern of three screw holes 702 on each bracket 302, 303, and thread into corresponding screw bosses 703 on the base frame 600. Each bracket includes a cylindrical flange 704 that forms a pivot surface that fits over a corresponding base mounting boss 1602 on the rear housing 102, as described in more detail with reference to FIG. 20.

Figure 8:
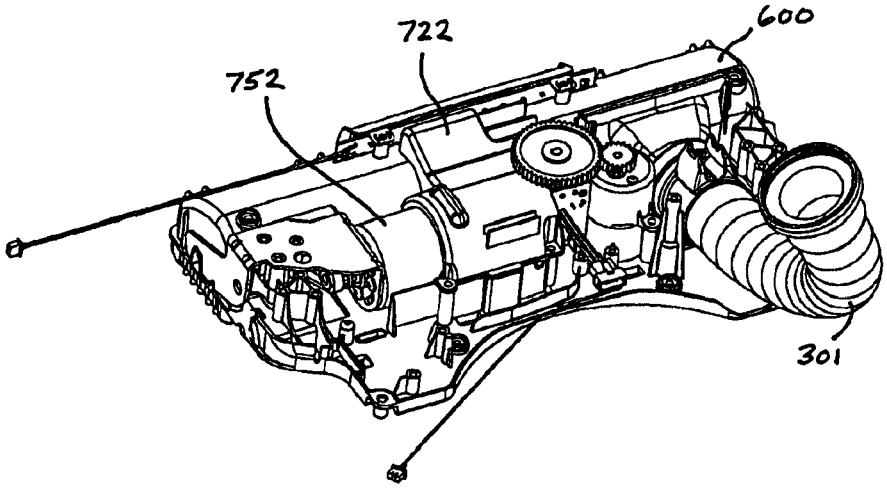
FIG. 8 is a rear isometric view of the base frame of the embodiment of FIG. 1.
Figure 9:
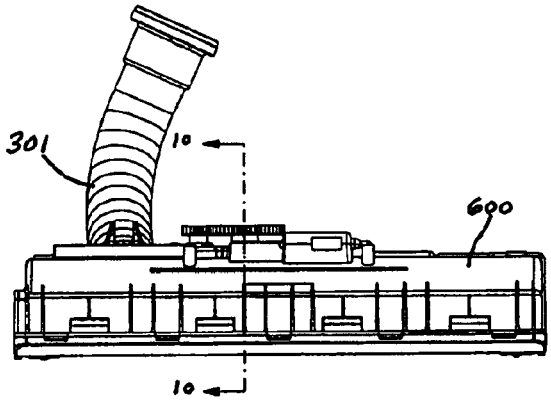
FIG. 9 is a front view of the base frame of the embodiment of FIG. 1.

Referring now more specifically to FIGS. 7 and 8, the base frame 600 and the parts attached thereto are described in more detail. As noted before, the base frame 600 is constructed as a molded part having the brushroll chamber 502 formed in its bottom surface. Various parts are attached to the base frame 600. Among these are the headlight assembly 605, a nozzle height adjustment assembly 705, a wheel carriage assembly 706, a brushroll 701, and a brushroll motor assembly 707.

The headlight assembly 605 comprises a printed circuit board 708 having a plurality of light emitting diodes (LEDs) 709, which are arranged in a line or other pattern, and a reflector 710. The printed circuit board 708 is attached to the electrical system of the vacuum cleaner by way of an electrical lead 711 that contains the wires necessary to operate the LEDs 709. The LEDs 709 may comprise any commercially available LED of any color, but preferably all have the same wavelength. The LEDs 709 are preferably generally white in color, which is expected to provide relatively natural-looking lighting of the surface being cleaned. In order to provide multiple different lighting levels, the LEDs 709 may be activated individually or in groups. For example, half of the LEDs 709 may be lit to provide a medium light intensity, while all of the LEDs 709 may be lit to provide the brightest light intensity. The LEDs 709 may also be lit in smaller groups, or even one at a time, to provide even greater gradations in the light intensity.

While the use of LEDs 709 of the same wavelength is preferred, the LEDs may alternatively be selected with different colors that provide a unique light signature on the surface being cleaned. If LEDs having various different colors are provided, these may be activated separately to provide their native color, or in combination with one another to overlap and provide combined colors. For example, red, blue and green LEDs can be combined to generate a white light.

The reflector 710 preferably comprises a reflective material or has a reflective coating applied to it. The reflector 710 has a series of holes 712 through which the LEDs 709 project when assembled. Each hole 712 is preferably surrounded by a depression having a parabolic or other shape that forms a focusing lens to help project light from the LEDs 709 in a generally forward direction. These focusing lenses may also be shaped to project the light from the LEDs 709 in a fan-shaped pattern in front of the vacuum cleaner, downward, upward, or in various other patterns. For example, one or more focusing lenses at each end of the reflector 710 may be shaped to focus light from their respective LEDs 709 out towards opposite sides of the device, while the remaining ones focus the LED light directly forward and down at a slight angle. This pattern may be useful for general cleaning. Such variations in the light pattern may also be provided by changing the pattern, orientations and/or locations of the LEDs 709, and other variations will be apparent to those of ordinary skill in the art in view of the present disclosure and with practice of the invention.

The reflector 710 includes tangs 713 that snap into corresponding slots 714 in the printed circuit board 708, and help hold the reflector 710 in the proper location relative to the LEDs 709. The reflector 710 also includes mounting holes 715 through which screws (not shown) are passed to attach the headlight assembly 605 to screw bosses 716 on the base frame 600. The base frame 600 also includes a slot or indentation 717, which receives the bottom edge of the printed circuit board 708, and acts to further stabilize the LEDs 709.

The nozzle height adjustment assembly 705 and a wheel carriage assembly 706 are also attached to the base frame 600. The nozzle height adjustment assembly 705 comprises an electric height adjusting motor 718, which is powered by electrical lead 719. The height adjusting motor 718 is mounted in a pocket 720 in the base frame 600, and oriented with its output shaft 721 aligned generally vertically (i.e., perpendicular to the ground). A motor cover assembly 722 encloses the top of the height adjusting motor 718. The pocket 720 and motor cover assembly 722 preferably form an enclosure having an air vent (not visible) located at one end of the height adjusting motor 718, and a vacuum bleed hole 723 at the other end of the height adjusting motor 718. The vacuum bleed hole 723 is fluidly connected to the fan/motor 1603 (FIG. 16) by a vacuum hose (not shown) so that the vacuum fan draws in any carbon dust generated by the height adjusting motor 718, and filters it from the atmosphere.

The output shaft 721 extends through a hole (not visible) in the motor cover assembly 722, and a toothed drive gear 724 is attached to the end of the output shaft 721. The portion of the output shaft 721 that fits within the drive gear 724 and the hole in the drive gear 724 are D-shaped, splined or otherwise shaped to provide a non-rotatable interface between the two parts. A simple press fit may be used to hold the drive gear 724 in place, or it may be further held by a key, pin, or other known device. Of course, other gear mounting methods and structures may be used.

Figure 10:
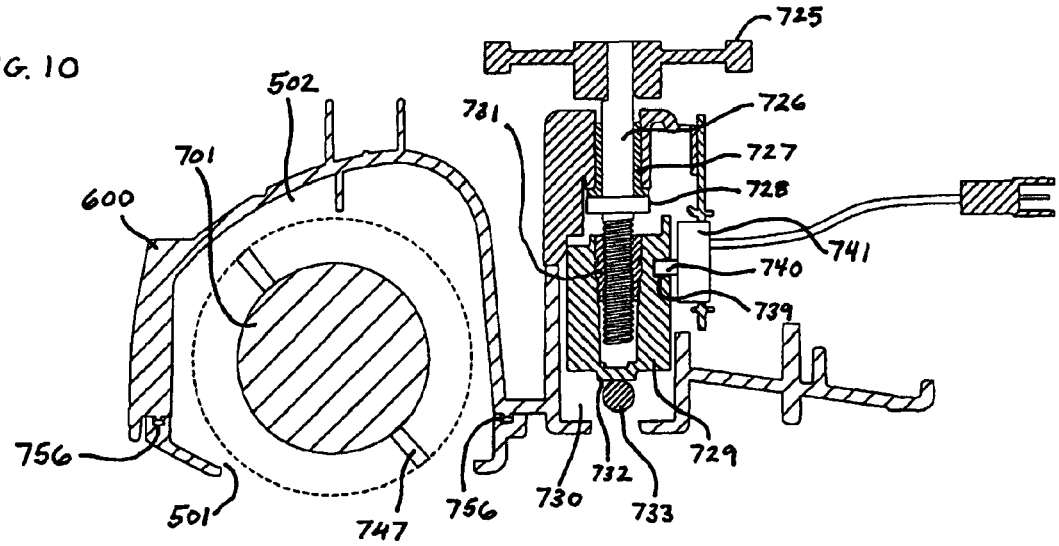
FIG. 10 is a section view as seen along reference line 10-10 of the embodiment of FIG. 9.

Referring now more specifically to FIG. 10, the drive gear 724 is located adjacent to, and in toothed engagement with, a toothed driven gear 725. The driven gear 725 is connected to a height adjusting screw 726 in the same or similar manner as the drive gear 724 is attached to the motor's output shaft 721 (e.g., by press fit over a D-shaped portion of the height adjusting screw 726). The height adjusting screw 726 extends downwardly through the motor cover assembly 722, and is pivotally journaled in a brass bushing 727 that is pressed into the motor cover assembly 722. A shoulder 728 on the height adjusting screw 726 prevents the height adjusting screw 726 from moving upwards through the motor cover assembly 722. The bottom of the height adjusting screw 726 comprises a threaded shaft, which engages a correspondingly threaded adjustment block 729.

The adjustment block 729 comprises a generally cubic block that is adapted to slidably fit within a corresponding pocket 730 in the base frame 600. A threaded insert 731, which is preferably made of a steel or another wear-resistant material, is anchored in the adjustment block 729, and sized to receive and threadingly engage the threaded shaft of the height adjusting screw 726. Using this arrangement, the motor 718 can be used to rotate the height adjusting screw 726, and thereby raise and lower the adjustment block 729 within the pocket 730. The lower surface 732 of the adjustment block 729 engages a crosspiece 733 on the wheel carriage assembly 706.

Referring back to FIGS. 5 and 7, the wheel carriage assembly 706 comprises a wire axle 734 that is bent at each end to form wheel mounts 735, and in the middle to form a crosspiece 733. Each wheel mount 735 has a wheel 736 pivotally mounted to it and held in place by a pushnut, as known in the art. The axle 734 is attached to the bottom surface of the base frame 600 by two axle clamps 737, as best shown in FIG. 5, and is pivotable relative to the base frame 600 about the axis of the axle 734 where it is held by the clamps 737. When so mounted, the crosspiece 733 is located adjacent the lower surface 732 of the adjustment block 729. The crosspiece 733 is held in engagement with the lower surface 732 by a spring 738 that is connected to both the crosspiece 733 and the base frame 600. The crosspiece 733 and the wheel mounts 735 are offset from the pivot axis of the wheel carriage assembly, and so the vertical movement of the adjustment block 729 causes the wheels 736 to move towards or away from the base frame 600, thereby adjusting the height of the inlet nozzle opening 501 (FIGS. 5 and 10) relative to the surface that the wheels 736 are resting on.

Figure 27:
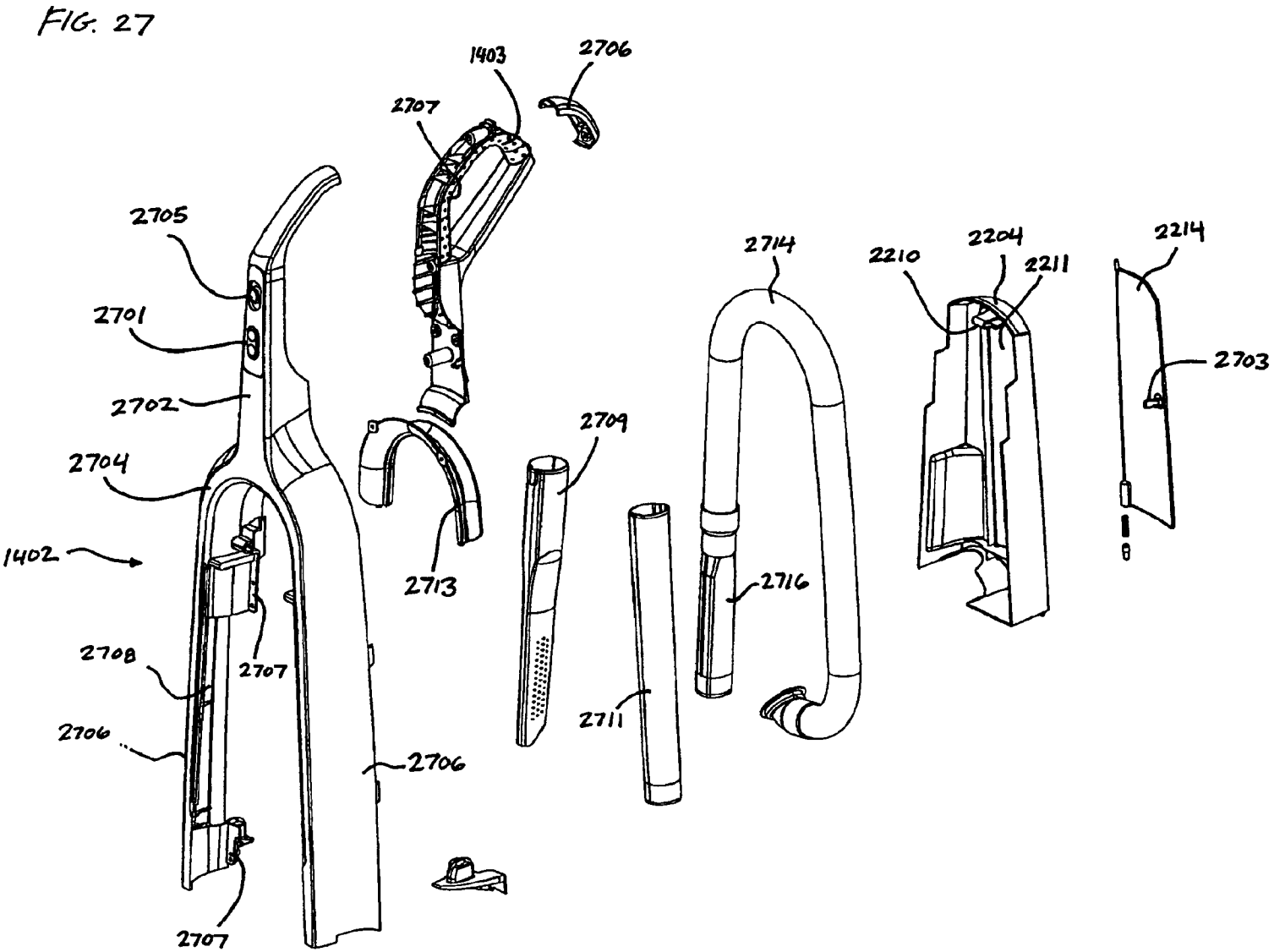
FIG. 27 is an exploded front view of the housing assembly of the embodiment of FIG. 1.

The height adjusting motor 718 may comprise any type of motor that can be selectively operated in either rotational direction, such as a servo motor, and electronics may be provided to operate the motor 718. In a preferred embodiment, the height adjusting motor 718 is controlled be a hand-operated control 2701 located on the vacuum's grip post 2702 (FIG. 27). The motor 718 may alternatively be controlled by a switch located somewhere other than the grip post 2702, such as by a footswitch on the base 101, or may be operated automatically, as known in the art. A combination of controllers may also be used to operate the height adjusting motor 718. For example, a hand-operable switch may be used to control the motor 718 during floor cleaning operations, but a control circuit may automatically lower the wheels 736 (i.e., raise the nozzle) when an obstruction is detected in the air flow path, or when an accessory cleaning mode is activated.

The height adjusting assembly 705 also preferably includes devices to prevent it from being damaged by over-rotation, and a display system to indicate the height of the inlet nozzle. To this end, the adjustment block 729 includes a slot 739 located in one vertical side thereof. The slot 739 is positioned to receive an actuating arm 740 of a slide potentiometer 741, as shown in FIG. 10. As the adjustment block 729 is raised and lowered in its pocket 730, the actuating arm 740 is moved up and down, causing the resistance of the slide potentiometer 741 to change. This change in resistance is measured by a control circuit located in a circuit board 742 and used deactivate the height adjusting motor 718 when the adjustment block 729 is at the limits of its desired travel. This prevents the operator from damaging the motor 718, gears 724, 725, or other parts by attempting to operate the motor 718 when it is not possible for the adjustment block 729 to move any farther. The limits of travel may be pre-set at the factory, and may also be field-serviceable to allow an operator to recalibrate the resistance scale. The travel limits may alternatively be measured by detecting the change in current experienced by the height adjusting motor 718 as it abuts the limits of its travel, by limit switches separate from the potentiometer 741, or by other suitable means.

The height adjusting assembly 705 also uses the variable resistance potentiometer 741 to indicate the height of the nozzle inlet on the lower display board 608, which is attached to the circuit board 742 by an electrical lead 743. The lower display board 608 preferably comprises a plurality of LEDs 744 that are arranged in a row. As the resistance changes, the control circuit illuminates the LEDs 744 to indicate the inlet nozzle height. The height may be displayed in relative terms (low, medium-low, medium, high, etc.), or absolute terms (1/16 inch, 1/8 inch, 1/4 inch, etc.). Suitable textual or graphic height indicators are printed adjacent the LEDs 744 on the display housing 607, the lower display cover 604, or directly on the lower display board 608.

The lower display board 608 may also be have other indicators or functions. For example, in the shown embodiment, the lower display board 608 also includes a fault indicating LED 745 that indicates if there is a problem operating the height adjusting motor 718. The fault LED 745 is a dual color (preferably blue and red) LED that illuminates when the brushroll 701 is activated. The fault LED 745 is blue when the brushroll 701 operating normally, and red if the brushroll has been turned on but is jammed or otherwise not operating properly. A current sensing circuit that measures the current increase when the brushroll motor 752 stops or slows is preferred for operating the fault LED 745. This circuit may also include a circuit breaker and a reset button to reset the brushroll motor 752 after it has been stopped. However, a rotation detecting device, or other devices may be used to determine when the brushroll 701 is operating under a fault condition and appropriately illuminate the fault LED 745. Other fault indicators may also be useful, for the lower display board 608, such as an LED that illuminates whenever the brushroll unexpectedly stops.

The brushroll 701 may comprise any type or combination of agitating members, such as a series of tufted bristles, rubber flaps, rigid protrusions, and the like, which are disposed around the periphery of a rotating member. The main body of the brushroll may comprise a cylindrical or helical member formed of plastic, wood, metal, or other materials, that is suspended on bushings or bearings that allow rotation thereof. The term "brushroll," as used herein, is not limited to requiring bristles or brushes on the roller body or having a cylindrical body, but rather is intended to encompass any device, or combination of devices or materials that contribute to the agitation of a surface to be cleaned with the intent to aid in dislodging matter from the surface.

Figure 12:
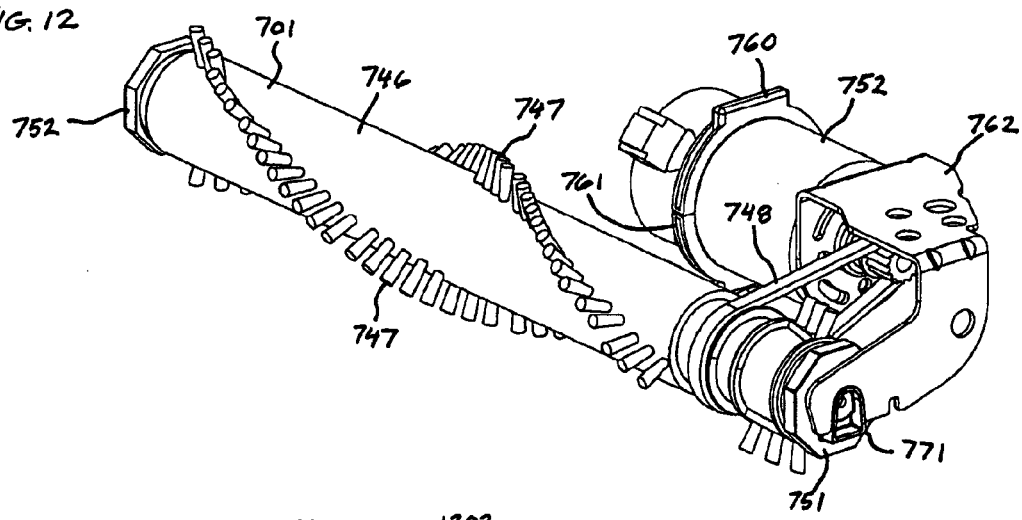
FIG. 12 is an isometric view of the embodiment of FIG. 11, shown attached to a brushroll motor and a brushroll.

As shown in FIGS. 7 and 12, a preferred brushroll 701 comprises a spindle 746 to which two rows of bristles 747 are attached in a helical pattern. The brushroll 701 is driven by a drive belt 748, which may have a flat, grooved, trapezoidal or other profile, and may be toothed to provide greater drive force. The motor and brushroll pulleys are typically contoured according to the type of belt being used. In a preferred embodiment a toothed brushroll pulley 749 is attached at an intermediate location along the spindle 746, either by being screwed in place, by a friction fit, by a key to prevent rotation, by molding it in place, or by other means. The brushroll pulley 749 may alternatively be located at the end of the spindle 746. The brushroll pulley 749 may be a separate part that is installed on the spindle 746, or may be formed integrally therewith. Drive gears and other arrangements may also be used in other embodiments. The ends of the spindle 746 are suspended by bearings (not visible) or bushings, which are located in first and second bearing caps 750, 751. Except as otherwise discussed herein, the bearing caps 750, 751 may comprise any conventional design. Examples of suitable designs are shown in U.S. Pat. Nos. 5,373,603, 5,435,038, and 6,591,440, which are incorporated herein by reference.

The brushroll 701 may be powered by any type of motor, such as an air turbine, an electric motor that drives the vacuum fan (e.g., fan/motor 1603) or a water pump (as in wet extractors), or, most preferably, a separate brushroll motor 752. A clutch or other mechanism may also be provided to disengage the brushroll 701 or disable the brushroll motor 752 when the brushroll jams, stops, or clogs or to shut off the brushroll when its operation is not required.

The brushroll 701 is mounted in the brushroll chamber 502 by inserting the first bearing cap 750 into an opening 753 formed by and between the base frame 600 and a sole plate 754. This opening 753 is best shown in FIGS. 5 and 7. The second bearing cap 750 fits into a similar opening on the other side of the brushroll chamber 502. When installed, the brushroll 701 is rotatably mounted in the brushroll chamber 502 above the inlet nozzle opening 501, with the bristles 747 extending through the nozzle opening 501 so that they can contact the surface being cleaned, as best shown in FIG. 10.

The sole plate 754 comprises a plastic or metal part that is removably attached to the bottom of the base frame 600. In a preferred embodiment, this attachment is by tabs 755 in the front, and screws (not shown) at the back. A seal 756 (FIG. 10) is preferably provided to prevent vacuum leakage through the juncture between the sole plate 754 and the base frame 600. The inlet nozzle opening 501 is formed through the sole plate 754, and a number of ribs 757 partition the inlet nozzle opening 501 into smaller openings to prevent large objects from being ingested and strengthen the sole plate 754. The sole plate 754 also includes a pair of raised walls 758 that closely follow the circumference of the brushroll 701 on either side of the brushroll pulley 749 to help prevent dirt and debris from contaminating the brushroll drive system. A pair of matching walls 503 (FIG. 5) are provided in the brushroll chamber 502 around the brushroll 701, and felt seals (not shown) are provided in both sets of walls 758, 503 to abut the brushroll and complete the seal. This and other brushroll pulley sealing arrangements are known in the art, and any such arrangement may be used with the present invention. The sole plate 754 may also include edge cleaning bristles 759 to help agitate and clean the edges of the vacuum cleaning path, and may have one or more wipers (not shown) that extend downwards to help capture debris.

Figure 11:
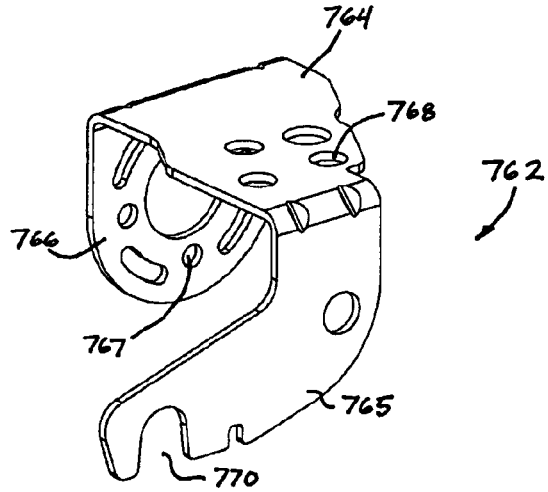
FIG. 11 is an isometric view of an embodiment of an alignment bracket of the present invention.
Figure 13:
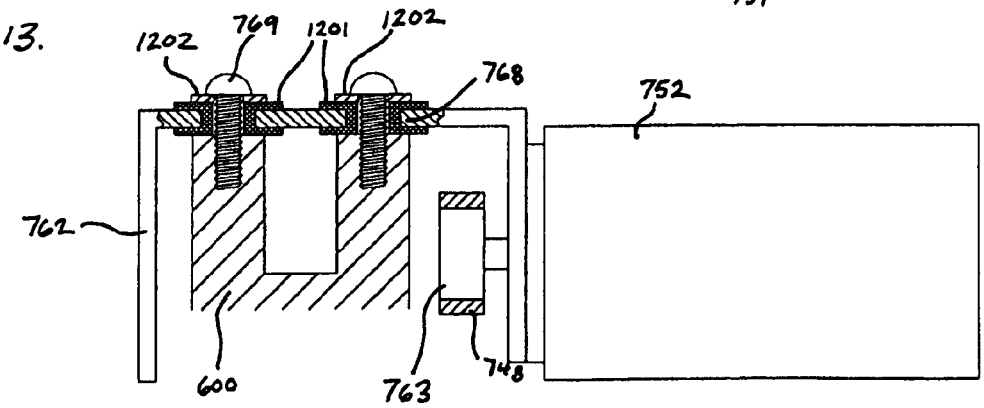
FIG. 13 is a schematic view of a variation of the embodiment of FIG. 11, shown mounted to a base frame.
Figure 14:
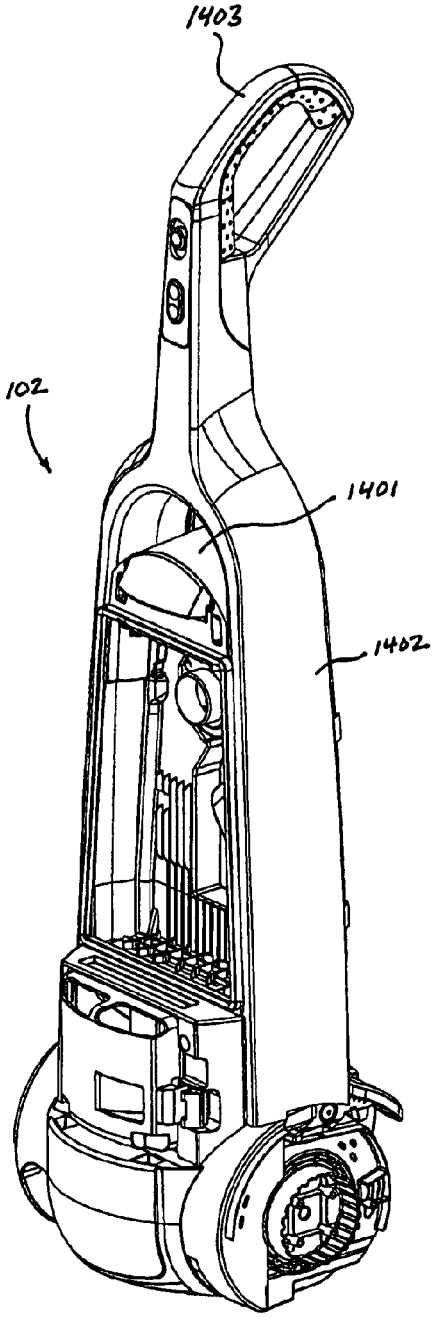
FIGS. 14 and 15 are front and rear isometric views of the rear housing of the embodiment of FIG. 1.

The present invention provides an improved brushroll motor assembly 707 and brushroll mounting system that is believed to prevent or minimize problems with belt failure, and allow the motor to be soft-mounted to the vacuum cleaner to reduce undesirable vibration, noise and fatigue. As best shown in FIGS. 11-13, the brushroll motor assembly 707 generally comprises a brushroll motor 752, upper and lower motor mounting grommets 760, 761, and an alignment bracket 762. The brushroll motor 752 drives a motor pulley 763, which is pressed onto or otherwise attached to the motor's output shaft. The drive pulley 763 may be provided with teeth that match those of the brushroll pulley 749, and the motor pulley 763 and brushroll pulley 749 are attached to one another by the drive belt 748.

A common problem with known brushroll motor assemblies is that the drive belts often wear, slip, break or jump off the pulleys, which necessitates periodic maintenance or repair by the consumer or a repair facility. It is believed these problems are caused, at least in part, by the inability of current brushroll and motor mounting designs to maintain the desired center distance and alignment between the motor pulley 763 and the brushroll pulley 749. As used herein, the center distance refers to the distance between the rotating axes of the pulleys 763, 749. It has been found that maintaining a constant center distance is important because the center distance dictates the amount of tension that the drive belt 748 experiences when it is initially placed over the pulleys 763, 749, and when it is driven by the brushroll motor. If the center distance increases, so does the belt tension, and when the distance decreases, the tension decreases (assuming the belt length remains constant). Lower tensions may allow slipping and greater lashing loads when the motor 752 is initially started, particularly if the tension at rest is at or near zero. The alignment between the rotating axes of the motor and brushroll (whether it is parallel, perpendicular or whatever arrangement is appropriate for the particular drive system) is also important because misalignment can cause damage even if the center distance remains constant.

There are various causes of motor/brushroll center distance and alignment variation. For example, the housing parts, such as base frame 600, into which the brushroll 701 and motor 752 are mounted are often subject to substantial manufacturing variances, particularly when the parts are plastic, and these manufacturing variances can cause the brushroll and motor pulleys 749, 763 to be out of alignment or at an improper distance from one another. This is particularly true when the brushroll 701 and motor 752 are mounted in different housing parts, in which case the manufacturing tolerances can stack and be even greater. If the housing variance is greater than the operational tolerances of the belt, then the belt may experience excessive or insufficient tension, resulting in stretching, breaking, slipping or belt jumping. Such variances can also cause the pulleys 763, 749 to be out of alignment, which can cause excessive heat generation that leads to premature wear or loss in belt tension caused by overheating or stretching. The motor/brushroll center distance and alignment are also affected by a phenomenon known as "cold flow," which is a gradual deformation that occurs when a force is applied to the plastic housing. Cold flow is often caused by the drive belt 748, which is mounted in tension over the pulleys 763, 749. This tension applies a force that draws the motor pulley 763 and brushroll pulley 749 together, causing the housing to deform and reducing the motor/brushroll center distance. Such deformation may occur, for example, at the openings 753 that hold the brushroll bearing caps 750, 751, where the brushroll motor 752 mounts to the base frame 600, or elsewhere. Still another factor that contributes to improper center distance and misalignment is the operating tension of the drive belt, which is greater than the static tension. The operating tension can cause the mounting system to flex during operation (as well as encouraging cold flow), thereby pulling the brushroll 701 and motor 752 out of alignment and changing the center distance during use. Similar alignment issues may be caused in a gear-operated embodiment by gear tooth thrust forces that tend to push gears apart and/or perpendicular to the gear face (as in the case of helical gears).

Another problem with known brushroll designs is that the brushroll motor often transmits vibration to the cleaner in which it is mounted, resulting in additional noise and component fatigue. Problems with vacuum noise are believed to be caused, in part, by the manner in which brushroll motors are mounted to cleaners. In a typical prior art device, the brushroll motor is rigidly captured within the vacuum housing by plastic supports. In other cases, the motor may be mounted to one of the housing portions by straps, clips, screws, or other holding devices, rather than being captured between the housing portions. Such typical motor mountings transmit vibration directly to the housing, increasing the overall amplitude of the noise emanating from the device. While it would be possible to soft-mount the motor to the housing (e.g., mount the motor by way of flexible bushings that damp vibrations and reduce noise), doing so is often problematic because it allows the motor to move relative to the housing and, more importantly, relative to the brushroll. This would exacerbate the problems already caused by misalignment and motor/brushroll center distance variations.

The present invention addresses these problems by providing a rigid connection that solidly positions the brushroll 701 and brushroll motor 752 relative to one another, to maintain the desired center distance and alignment between the motor pulley 763 and the brushroll pulley 749. In doing so, the present invention also allows the motor 752 to be soft-mounted to the base frame 600, which leads to the additional benefit of reduced noise and fatigue. It is anticipated that the present invention will reduce drive belt problems and increase belt life expectancy, possibly to the point that the belt will never need to be replaced (a so-called "lifetime" belt). Further benefits include quieter operation provided by a soft-mounted brushroll motor 752.

As shown in FIGS. 7 and 11, the brushroll motor assembly 707 includes an alignment bracket 762. The bracket 762 comprises a housing mounting portion 764, a brushroll mounting portion 765, and a motor mounting portion 766. The motor mounting portion 766 has one or more openings 767 through which screws (not shown) or other fasteners are passed to rigidly mount the bracket 762 to the brushroll motor 752. Alternatively, the bracket 762 can be welded to the brushroll motor housing, or formed integrally therewith.

Similarly, the housing mounting portion 764 has one or more openings 768 through which fasteners, such as screws 769 (FIG. 13), pass to mount the bracket 762 to the base frame 600. The brushroll mounting portion 765 also has an opening 770 into which a corresponding protrusion 771 on the second bearing cap 751 fits. The protrusion 771 is prevented from exiting the opening 770 by contact with the upper surface of the sole plate 754.

The alignment bracket 762 rigidly holds the end of the brushroll 701 and the brushroll motor 752 together, as shown in FIG. 12, so that their centerline distances and alignment do not vary from the desired value by any appreciable amount, either as a result of manufacturing tolerance variations, cold flow (which, when it occurs in metal, is also known as "creep"), or other factors. In one embodiment, the bracket 762 may be made of a plastic or composite material having high manufacturing tolerance quality (i.e., little variation from one part to the next) and that is shaped and sized to resist the forces that cause cold flow or is selected from a material that resists cold flow, such as a plastic containing rigidity-enhancing agents such as glass fiber, talc and the like. It is preferred, however, to manufacture the bracket 762 from a metal material that can be manufactured to a relatively high tolerance quality, resists creep, and is strong enough to be configured with a minimal size to take up as little space as possible. Steel, magnesium, aluminum, zinc, and alloys thereof, are examples of suitable materials.

The bracket 762 may be made by any suitable manufacturing process, such as: casting with the necessary openings in place, casting then drilling or otherwise machining the openings, stamping a sheet with the necessary shape and with the holes in place then folding the sheet to form the desired shape, stamping and folding a sheet of metal then machining the openings, and so on. Powdered metal casting, sintering and metal injection molding are also expected to be useful for inexpensively producing a fully-formed, highly-accurate and robust final bracket part without the added expense or necessity of additional machining. It is also anticipated that it may be convenient or otherwise desirable to manufacture the alignment bracket 762 out of numerous parts, such as separate brushroll or motor mounting portions that are fitted together, or to form the bracket with additional parts. It is further anticipated that the alignment bracket 762 may be indirectly mounted to the brushroll, motor, or housing, such as by being mounted indirectly by way of a spacer or adapter plate fitted between the alignment bracket 762 and the brushroll motor 752, brushroll 701 or base frame 600. All such variations are included within the scope of the present invention.

As shown in FIGS. 11 and 12, the alignment bracket 762 forms an arch-like structure having a space located between the brushroll mounting portion 765 and the motor mounting portion 766. The drive belt 748, motor pulley 763 and brushroll pulley 749 are positioned in this space. The protrusion 771 on the second end cap 751 is fitted into the opening 770 in the brushroll mounting portion 765 of the alignment bracket 762, thereby preventing or greatly limiting and relative translational movement between the rotating axes of the brushroll motor 752 and the brushroll 701.

While the opening 770 is shown as being a slot that is open on one side, it may alternatively comprise an hole that completely surrounds the protrusion 771. In addition, while the use of the interlocking opening 770 and protrusion 771 arrangement shown in the Figures is preferred, the bearing cap 751 may alternatively (or additionally) be rigidly attached to the alignment bracket 762 by fasteners, such as a clips or screws. While such attachments are within the scope of the invention, they are less preferred because they might cause some inconvenience when attempting to remove the brushroll 701.

While this embodiment of the alignment bracket 762 is shaped in an arch-like manner, it is also within the scope of the invention to make the alignment bracket 762 with other shapes, such as a flat shape, in which the drive belt 748, motor pulley 763 and brushroll pulley 749 are located outside the bracket 762. Such variations may require modification to the brushroll motor, pulleys, brushroll and/or the brushroll mounting system, but such modifications will be within the ability of those of ordinary skill in the art in light of the teachings provided herein.

Figure 6:
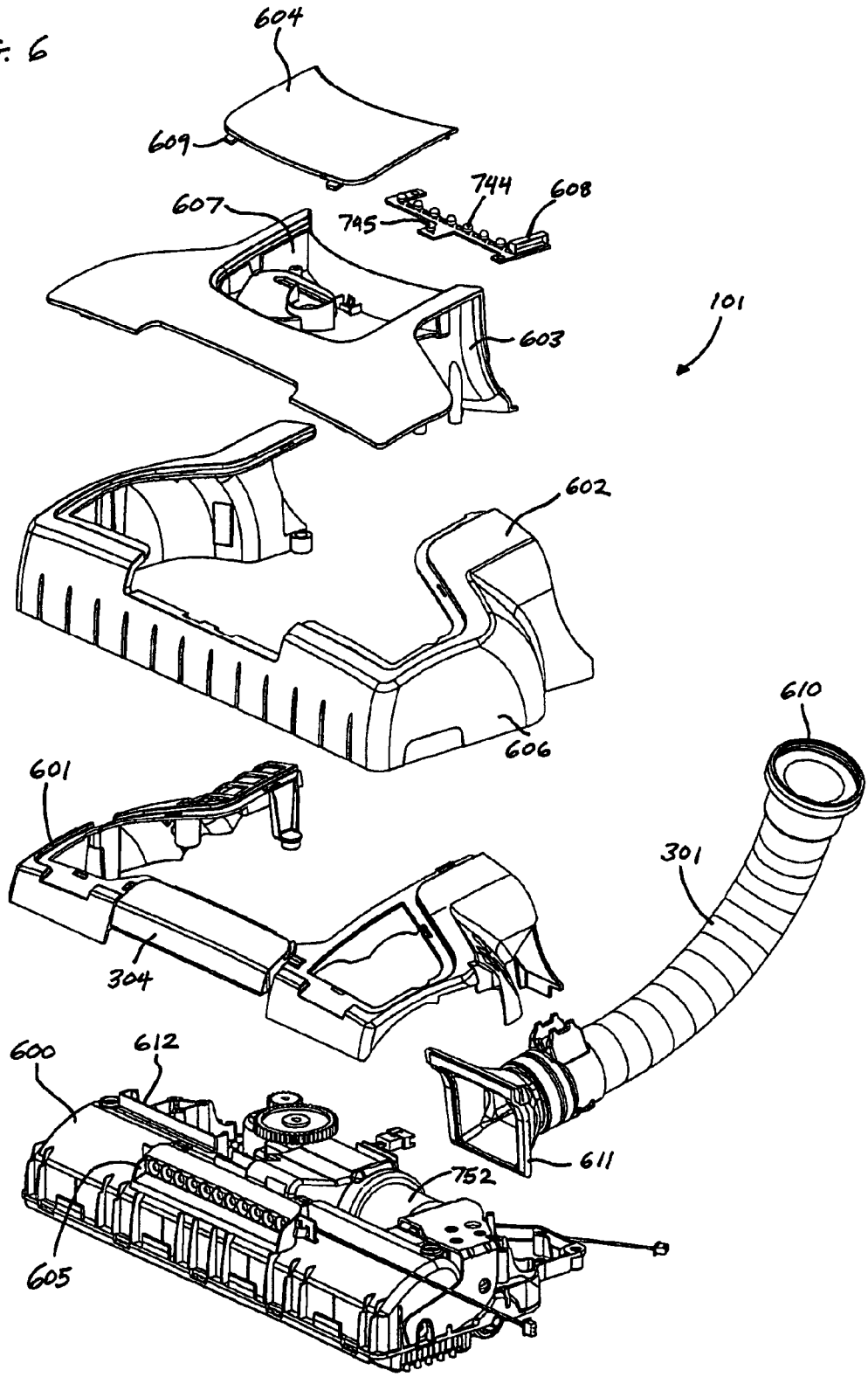
FIG. 6 is an exploded view of the base of the embodiment of FIG. 1.

As shown in FIGS. 6 and 8, the brushroll motor 752 preferably is covered by a portion of the motor cover assembly 722, along with the height adjusting motor 718. A seal (not shown) may optionally be located between the motor cover assembly 722 and the base frame 600, as well as around the brushroll motor 752, to prevent air from passing through these junctures. Of course a separate cover may be used for each of the motors. As with the height adjusting motor 718, the motor cover assembly 722 contains the air that passes through and over the brushroll motor 752 so that it can be conveyed to the vacuum source and passed through filters to remove any pollutants that may emanate from the motor, such as motor brush dust particles. While the motor cover assembly 722 encases the motor, it preferably does not rigidly hold it in place. Contact between the brushroll motor 752 and the base frame 600 and motor cover 722 is preferably by way of elastic or foam mounting grommets 760, 761 that prevent the transmission of vibrations from the brushroll motor 752 to the base frame 600.

As shown in FIG. 13, the alignment bracket 762 is mounted to the base frame 600 by a number of screws 769, or other fasteners. Preferably, three screws 769 are arranged in a triangular pattern to provide a stable, three-point mount. The alignment bracket 762 is optionally isolated from hard contact with the screws 769 and the base frame 600 by one or more elastic mounting grommets 1201. Washers 1202 may be provided to prevent the screws 769 from pulling through or damaging the grommets 1201. The grommets 1201 preferably extend through the bracket holes 768 to isolate the shanks of the screws 769 from the alignment bracket 762. In this way, the alignment bracket 762 can be prevented from contacting the base frame 600 except by way of the grommets 1201. If contact does occur at other locations, it is preferably made through a rubber, foam, or other vibration-insulating material. The grommets 1201 may be rubber or any other vibration-reducing material. In an alternative embodiment, the grommets 1201 are omitted, and the motor 752, brushroll 701 and/or alignment bracket 762 may be rigidly attached to the base frame 600.

While the brushroll mounting system of the present invention is shown herein in an upright vacuum cleaner, it will be appreciated that it may be used with any type of motorized agitator that is subject to misalignment with its driving motor, including gear-driven brushrolls and belt- or gear-driven vertical-axis rotating brushes that are powered by electric motors, turbine motors, or similar drive motors. The brushroll mounting system may also be used in other applications, such as in powerheads for canister vacuums, in stick vacuums, and so on. Other variations will be readily apparent to those of ordinary skill in the art in light of the disclosures provided herein.

Turning now to FIGS. 14-33, the rear housing 102 and its various components are described in more detail. The rear housing 102 generally comprises a rear frame 1401 and a handle assembly 1402. The rear frame 1401 serves as the connection point for the base 101, and generally acts as the backbone of the rear housing 102, by holding the various other parts. The handle assembly 1402 extends upwards from the rear frame 1401 and terminates at a grip 1403.

Figure 16:
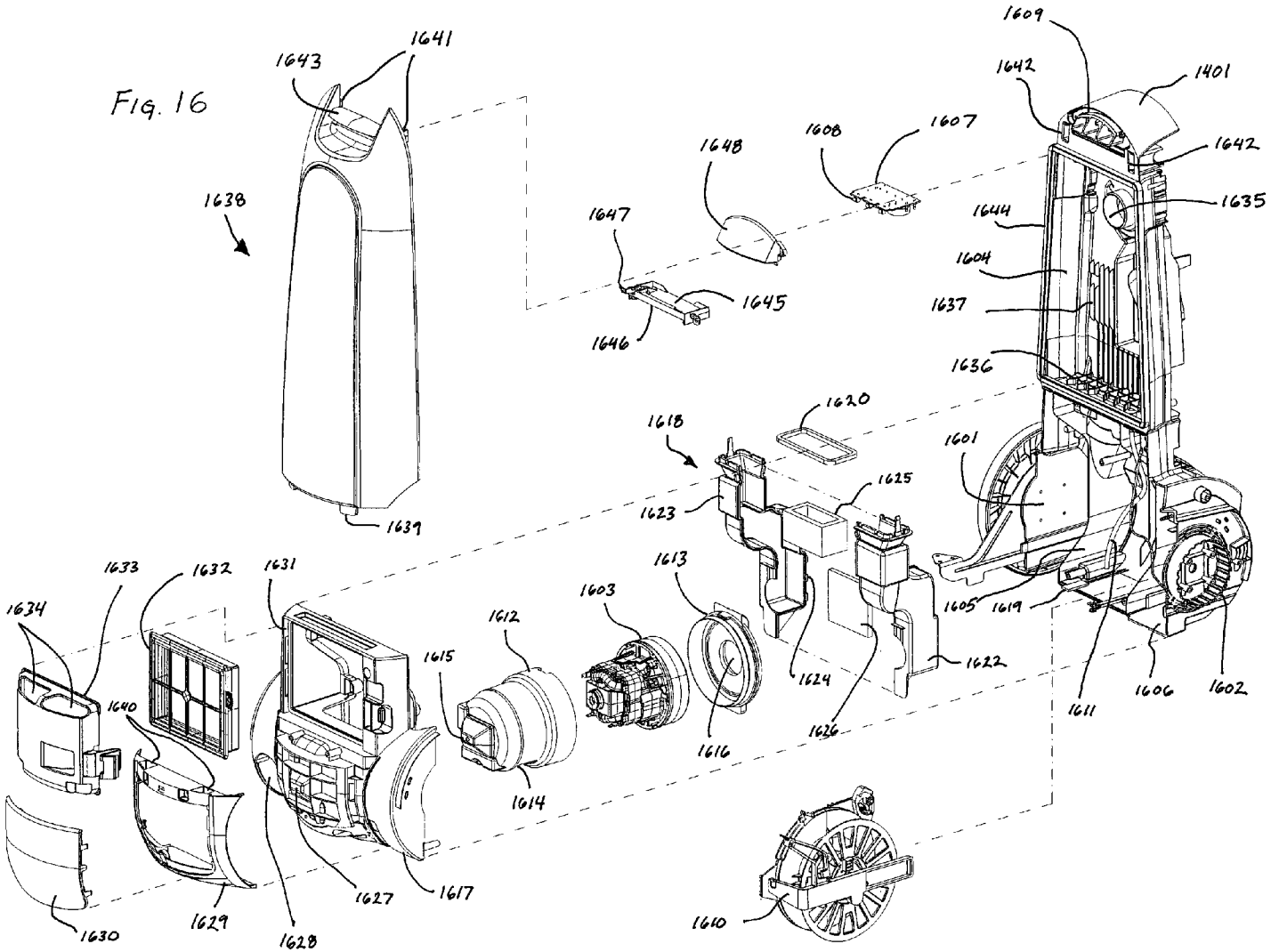
FIG. 16 is an exploded front view of the rear housing of the embodiment of FIG. 1.

Referring in particular to FIG. 16, the rear frame 1401 includes a vacuum bag chamber 1604, and a motor chamber 1605 located below the bag chamber 1604. This arrangement helps keep the center of gravity of the device low by placing the relatively heavy components as low as possible, and improves maneuverability and reduces the likelihood of tipping. A cordreel chamber 1606 is located on one side of the motor chamber 1605, and a hose slot 1601 for receiving the base hose 301 is located on the other side of the motor chamber 1605. A pair of base mounting bosses 1602 are provided on the exterior of the rear frame 1401.

The rear frame 1401 includes an upper display board 1607, which includes a number of LEDs 1608 and circuitry that illuminates the LEDs 1608 to provide information regarding the operating status of the vacuum cleaner 100. Examples of uses for the LEDs 1608 are to indicate when the vacuum bag or various filters require servicing, to indicate an interruption in the operation of the vacuum brushroll, to indicate that the device is plugged in, to indicate that the device is on, to indicate which cleaning mode the device is in (floor cleaning or accessory cleaning), and so on. Such circuitry is known in the art, and the LEDs 1608 may be conventional or as described elsewhere herein. The upper display board 1607 is installed such that the LEDs 1608 are visible through holes 1609 at the top of the rear frame 1401. An upper display lens 1648, of conventional design or as described elsewhere herein, may also be provided to cover the LEDs 1608 and provide a graphical or textual indicator of the purpose of each LED 1608.

In a preferred embodiment, the center LED 1608 is a blue LED that is illuminated when the vacuum cleaner systems are operating optimally. The side LEDs 1608 are red LEDs and are normally off. One side LED 1608 is illuminated to indicate that a filter change is necessary, and the other side LED 1608 is illuminated to indicate that a bag change is necessary. If either of the red lights come on, the center LED turns off. The side LEDs 1608 are controlled by pressure switches, which measure the pressure differential across the filter bag (not shown) and the post-motor filter 1632 (FIG. 16). When the differential drops below a predetermined value (indicating a significant blockage of the airflow), the appropriate LED 1608 is illuminated. Such pressure differential circuits are known in the art.

A cordreel 1610, which is described in greater detail elsewhere herein, is preferably oriented with its axis of rotation generally perpendicular to the fore-aft direction of the vacuum cleaner 100, and installed in the rear frame 1401 by sliding it backwards into the cordreel chamber 1606. When so installed, the extension cord plug (not shown) extends through a cord opening 1502 (FIGS. 15 and 22) on the back surface of the rear frame 1401. A cordreel pedal 1503 is pivotally attached on the back surface of the rear frame 1401 for releasing the cordreel, and is covered and held in place by a cordreel pedal housing 1504. A vacuum hose 1611 is attached between the cordreel 1610 and the vacuum bag chamber 1604, to help cool the cordreel 1610. The operation and features of the cordreel 1610 are described in greater detail elsewhere herein with reference to FIGS. 30-33.

A fan and motor assembly 1603 (fan/motor) is installed in the motor chamber 1605. The fan/motor 1603 may comprise any suitable motor and fan combination, as are known in the art, but is preferably provided with the motor and fan integrated as a single part. It is also preferred that the fan/motor 1603 be a self-cooled device, in which air exiting the impeller passes over the motor to cool it. Of course, the motor may also or alternatively be provided with a separate cooling fan.

The fan/motor 1603 is mounted with its axis of rotation aligned with the fore-aft direction of the housing (as it is when in the upright storage position). The fan/motor 1603 is encased in a shroud 1612, and sealed by a motor shroud gasket 1613. The shroud 1612 comprises a plastic housing having a shroud outlet 1614, and a mounting block 1615 comprising a pliable, vibration absorbing material, such as rubber. The mounting block 1615 extends through the shroud 1612 and directly contacts the end of the fan/motor 1603 to hold it in place within the shroud 1612. The shroud gasket 1613 also comprises rubber or another pliable, vibration absorbing substance, and has a motor inlet hole 1616 that surrounds the inlet to the fan/motor impeller. As such, when the fan/motor 1603 is assembled within the shroud 1612 and gasket 1613, the mounting block 1615 and gasket 1613 provide two vibration-reducing surfaces by which to mount the fan/motor 1603.

The fan/motor 1603 is mounted in the motor chamber 1605 between a motor cover 1617 and a motor inlet conduit 1618. A thermal cutoff device 1619 is preferably located in the motor chamber 1605 to protect the device and user from harm if the motor experiences a fault condition. A suitable thermal cutoff device is disclosed, for example, in U.S. Pat. No. 6,484,352, which is incorporated herein by reference.

The motor inlet conduit 1618 is mounted in the rear frame 1401 behind the fan/motor 1603, and fluidly connects the bag chamber outlet to the inlet of the fan/motor 1603. A gasket 1620 is provided at the upper end of the motor inlet conduit 1618 to seal it against the bag chamber 1604. The motor inlet conduit 1618 is preferably formed by two shell halves 1621, 1622 that are ultrasonically welded together to form a conduit, but other constructions may be used. In a preferred embodiment, the inlet conduit 1618 has a generally continuous cross-sectional profile, or a smoothly changing profile, but also includes one or more expanded regions, such as first and second expanded regions 1623 and 1624. These expanded regions are each filled with a respective foam block 1625, 1626 or other sound deadening material. The foam blocks 1625, 1626 may extend into the conduit 1618, but preferably are sized such that their inner surfaces blend into the cross-sectional profile of the inlet conduit 1618 at the locations immediately before and after each of the expanded regions 1623, 1624. In this way, when the foam blocks 1625, 1626 are installed, the inlet conduit 1618 has a continuous, or smoothly changing cross-sectional profile along its entire length. The use of the expanded regions 1623, 1624 and foam inserts 1625, 1626 is expected to reduce the overall noise level of the vacuum cleaner 100.

The motor cover 1617 is installed on the front face of the rear frame 1401 to capture the fan/motor 1603 and cordreel 1610 in place. To this end, the motor cover 1617 includes a detent 1627 into which the shroud mounting block 1615 fits. In addition to covering the motor chamber 1605, the motor cover 1617 preferably also covers and encloses the cordreel chamber 1606, and the hose slot 1601. An opening 1628 is provided on the motor cover 1617 over the portion that covers the hose slot 1601 to receive the base hose 301. The motor cover 1617 and/or rear frame 1401 may also be provided with one or more seals to seal the motor chamber 1605 and/or cordreel chamber 1606. The motor cover preferably comprises a first outer housing 1629, which is attached directly to the motor cover 1617, and a second outer housing 1630, which is attached to either the first outer housing 1630 or the motor cover 1617. These outer housings have been found to be useful to provide a multi-colored housing without resorting to complex molding and/or painting techniques. Of course, the motor cover outer housings may be omitted by forming the motor cover 1617 as a unitary part.

The motor cover 1617 forms an air flow passage to convey the air passing through the fan/motor 1603 to the atmosphere, and may simply comprise vents that directly exit the vacuum cleaner 100. However, it is often desirable for vacuum cleaners to have additional filtration to further clean the air exiting the fan/motor 1603. Therefore the motor cover 1617 (or rear frame 1401) may also include a post-motor filter mount 1631. The filter mount 1631 is in fluid communication with the motor chamber 1605, and is adapted to receive a post-motor filter 1632 that further cleans the air exiting the vacuum cleaner 100. In order to reduce noise generated by the vacuum cleaner 100, the shroud outlet 1614 is oriented downwardly, and the motor chamber 1605 is lined with a foam or other sound-deadening material, as known in the art. In this way, the air exiting the fan/motor 1603 passes along a circuitous route and a relatively long distance before exiting the vacuum cleaner 100, which is expected to achieve noise reduction over a more direct airflow path.

The post-motor filter 1632 may comprise any type of filter, such as pleated or foam filters, or combinations of filter types, and preferably is HEPA rated. A filter clamp 1633 may also be provided to hold the post-motor filter 1632 in place. The filter clamp 1633 preferably comprises a removable door-like structure that snaps onto the motor cover 1617 on one side by a flexible tab, and on the other side by rigid tabs, as known in the art. A preferred filter clamp 1633 has one or more openings 1634 located at its upper end to direct air leaving the filter upwards into an exhaust chamber 1701, which is described in more detail with reference to FIGS. 17-19. The post-motor filter 1632 and filter cover 1633 are shown installed in FIG. 20.

The vacuum bag chamber 1604 is formed in the forward face of the rear frame 1401 and shaped and sized to receive a vacuum bag (not shown). A bag inlet pipe 1635 extends into the bag chamber 1604 and is shaped and sized such that the vacuum bag can be installed over it to receive the incoming flow of dirt-laden air. An outlet grill 1636 is positioned at the lower portion of the bag chamber 1604 to cover an outlet (not visible) that leads to the fan/motor 1603 by way of inlet conduit 1618. A flat, pleated or other type of filter (not shown) may be installed to cover the bag chamber outlet to collect dust that is not filtered by the vacuum bag before the airstream enters the vacuum motor 1603. Such filters are typically referred to as pre-motor filters. A series of ribs 1637 may be provided along the vertical walls of the bag chamber 1604 to prevent the vacuum bag from pressing directly against the walls and limiting the airflow through the bag.

Figure 17:
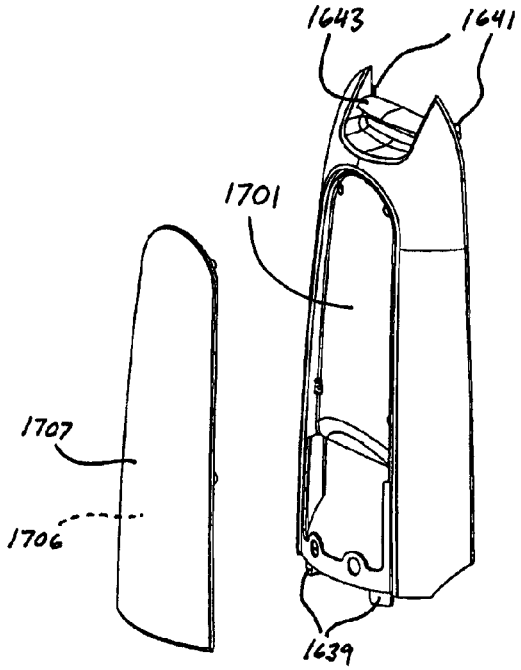
FIGS. 17 through 19 are isometric assembled and exploded views of the bag cover of the embodiment of FIG. 1
Figure 18:
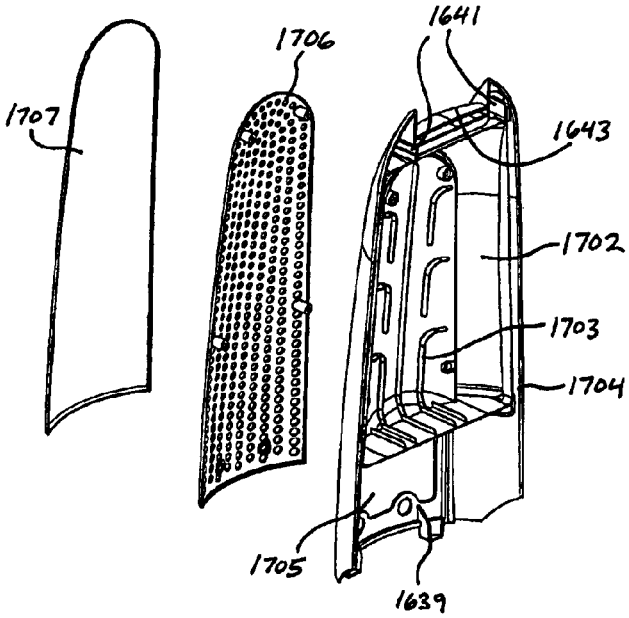
Figure 19:
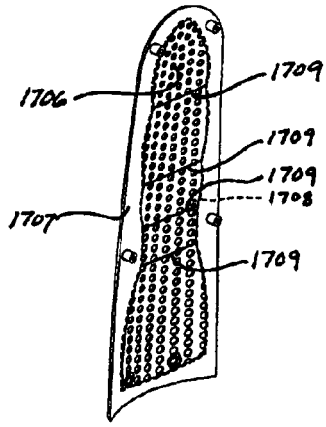

A bag cover 1638, which is shown in more detail in FIGS. 17-19, is removably attached to the rear frame 1401 to seal the front of the bag chamber 1604. While any attachment method may be used, the bag cover 1638 of this embodiment preferably is held in place at its bottom end by two downwardly-protruding tabs 1639 that fit into corresponding holes 1640 on the first outer motor housing 1629, although attachment to any other rigid part would be suitable as well. The top of the bag cover 1638 is held in place by rearwardly-projecting flexible tabs 1641 that releasably snap into corresponding holes 1642 in the rear frame 1401. The bag cover 1638 may also include a handle 1643 to facilitate removal and handling. The bag cover 1638 conveniently covers both the bag chamber 1604, and the post-motor filter 1632, which allows the bag and filter 1632 to be removed simultaneously, and ensures that the user is aware of the location of the filter 1632.

As shown in FIG. 18, the rear surface of the bag cover 1638 is shaped to form the front half of the bag chamber 1702, and may also have ribs 1703 to prevent the bag from pressing against the walls and limiting the airflow through the bag. The rear frame 1401 and bag cover 1638 have mating sealing surfaces 1704, 1644 to tightly seal the bag chamber 1604. Labyrinth seals, gaskets or other sealing devices may be used to provide this seal, as known in the art.

The bag cover 1638 preferably also includes an exhaust chamber 1701 that is positioned to receive and diffuse air exiting the post-motor filter 1632. The exhaust chamber 1701 generally comprises a channel between an opening 1705 through the bag cover wall, and a grate 1706, which is attached to the outer surface of the bag cover 1638. The opening 1705 is positioned adjacent the filter clamp openings 1634 when the bag cover 1638 is installed to thereby receive cleaned air exiting the fan/motor 1603. The grate 1706 preferably comprises a plastic panel having a plurality of circular holes passing therethrough, but other constructions are possible. The grate 1706 may be provided as a separate part of the bag cover 1638 that is attached by screws (not shown) or other attachment methods, or may be integrally formed as part of the bag cover 1638.

A fabric cover 1707 may be attached to the grate 1706, preferably on the outer surface thereof, by adhesives, wires, stitching, molding in place, or any other suitable means. As shown in FIG. 19, in a preferred embodiment, the fabric cover 1707 is attached by positioning it over and around the front of the grate 1706 and sewing a perimeter wire 1708 into the perimeter of the portion of the cover 1707 that extends around the back of the grate 1706. One or more tensioning wires 1709 are then attached to the perimeter wire 1708 to place it under tension, and thus stretch the fabric cover 1707 tight over the front of the grate 1706. Metal, nylon, or other materials may be used for the wires 1708, 1709, and any suitable cloth or nonwoven fabric material may be used as the fabric cover 1707.

In addition to providing an aesthetically-pleasing outward appearance, the fabric cover 1707 may also help diffuse and quiet the air flowing out of the vacuum cleaner 100. It is also expected to exhaust the air in a manner that does not generate objectionable strong gusts of air that can irritate the user or spread debris on the surface being cleaned.

The rear frame 1401 may also include a bag-in-place feature that prevents the bag cover 1638 from being installed when there isn't a vacuum bag in the bag chamber 1604. In one embodiment, the bag-in-place feature comprises a plate 1645 that is installed at the top of the bag chamber 1604. The plate 1645 includes a slot 1646 that receives a tab on the bag, and a spring-biased lever arm 1647 that is moved by the tab into a position in which it does not interfere with the mating sealing surfaces 1704, 1644 of the bag chamber 1604 and bag cover 1638. Such devices are known in the art, and any such device may be used with the present invention.

While the preferred embodiment illustrates a vacuum having a vacuum bag, it will be understood that this can be replaced by one or more cyclone separators, dirt cups or combinations of cyclones, cups and vacuum bags.

Figure 21:
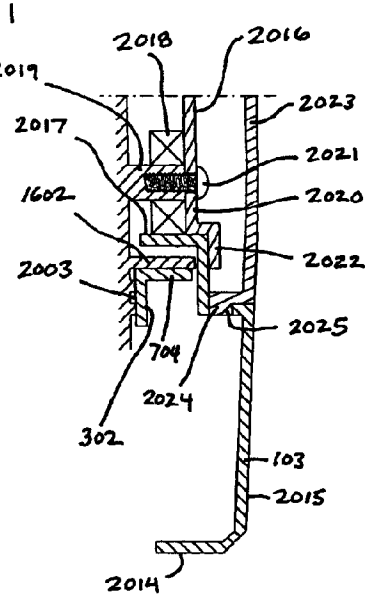
FIG. 21 is a section view of the wheel mounting arrangement of the embodiment of FIG. 20.
Figure 20:
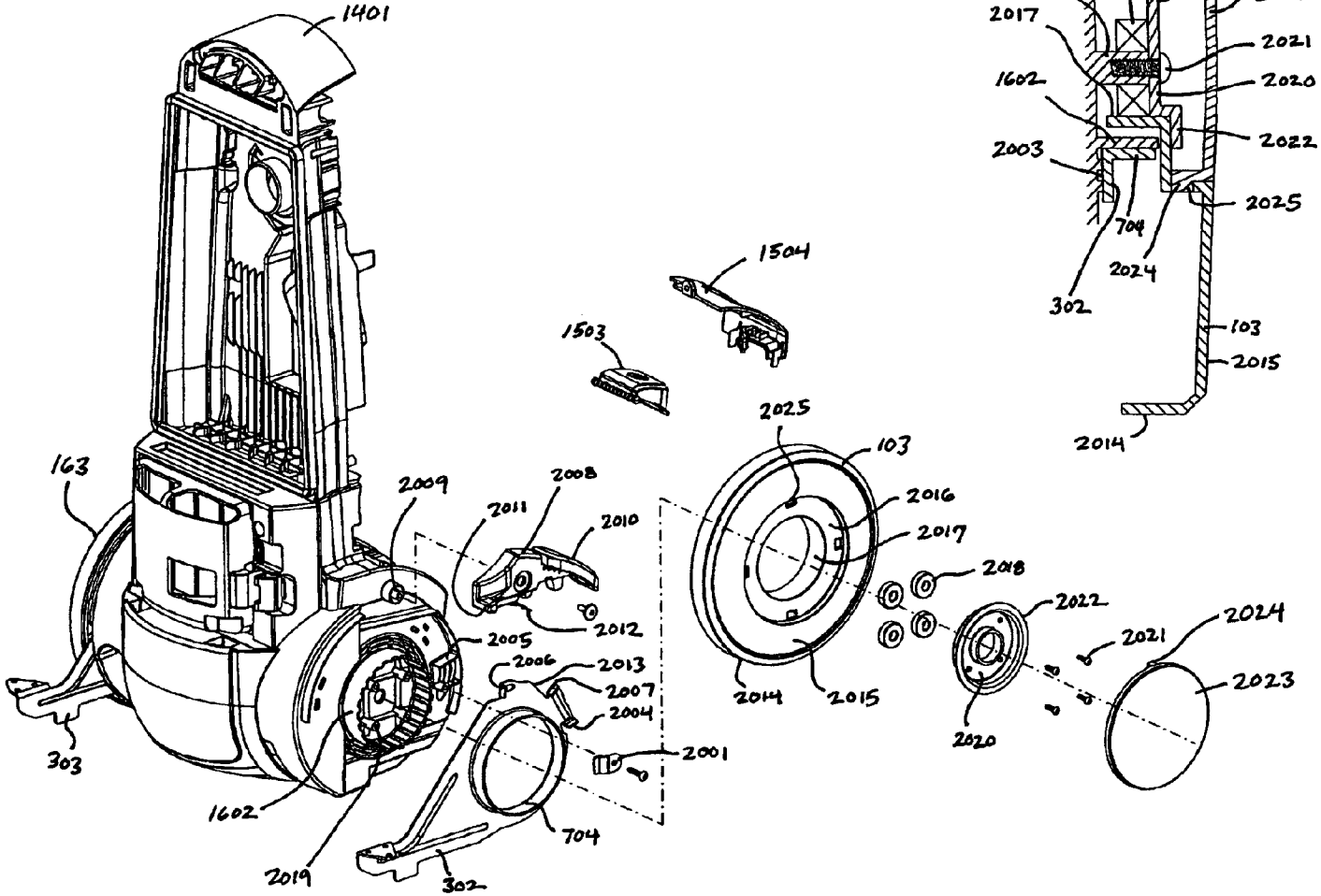
FIG. 20 is another exploded front view of the rear housing of the embodiment of FIG. 1.

Referring now to FIGS. 20 and 21, the present invention also provides wheel and base mounting arrangements that may be used on upright vacuum cleaners and other types of cleaning devices. FIG. 20 depicts the rear frame 1401 with the motor cover 1617, first and second outer housings 1629, 1630, and filter clamp 1633 installed. The right side wheel 103 (on the left in FIG. 20) and right side base mounting bracket 303 are also shown installed.

As noted before, the rear frame 1401 has a base mounting boss 1602 on each side at its lower end. Each base mounting boss 1602 comprises a generally cylindrical protrusion that extends laterally along an axis perpendicular to the fore-aft direction of the vacuum cleaner 100. The base mounting brackets 302, 303 each have a cylindrical flange 704 that fits over the corresponding base mounting boss 1602. When so assembled, the mounting brackets 302, 303 and bosses 1602 form a pivoting attachment between the base 101 and the rear housing 102. One or more clamps 2001 may be provided to abut the outer sides of the mounting brackets 302, 303 to hold them against the side of the rear frame 1401. Screws 2002 or other suitable devices may be used to hold the clamps 2001 in place, or the clamps 2001 maybe formed as parts of the device housing. In addition, the side of the rear frame 1401 (or other parts of the base mounting arrangement), may be provided with grooves 2003 to reduce the contact surface area, which may reduce friction and/or the likelihood of squeaks being generated during pivoting movement.

The base mounting bosses 1602 and/or the cylindrical flanges 704 may be provided as shown, and may be coated with relatively low-friction and low-wear materials so that they rotate smoothly on one another. These parts may also be self-lubricated or lubricated with dry or liquid lubricants. For example, the bosses 1602 and/or the flanges 704 may be steel, stainless steel, aluminum, acetal (also known as polyacetal, polyoxymethylene, or polyformaldehyde), or other engineering plastics, such as polycarbonate, glass-filled nylon, and so on. Suitable acetal materials include Delrin™, which is available from E.I du Pont de Nemours and Company, and Celcon™, which is available from Ticona, a division of Celanese Corporation. Conventional lubricants such as polytetrafluoroethylene (such as Teflon™), molybdenum disulfide, and so on may be used. One or more rings of friction-reducing and/or self-lubricating material may also be provided as a bushing between the flanges 704 and bosses 1602. Furthermore, one or more roller or ball bearings may be used to form a pivoting joint between these parts. Other variations will be apparent to those of ordinary skill in the art in view of the present disclosure.

The base attachment arrangement is also provided with travel stops to prevent the base 101 and rear housing 102 from rotating past a desirable range of movement. To this end, the left and right mounting brackets 302, 303 each have an upward travel stop 2004, which engages a corresponding surface 2005 on the rear housing 102 when the rear housing 102 is in the desired uppermost rotational position. Preferably, the upward travel stops 2004 and corresponding surfaces 2005 are positioned to allow the rear housing 102 to pivot to a generally vertical position in which the vacuum cleaner 100 can be left unattended with relatively little risk of it falling or being knocked over (the upright storage position).

The left mounting bracket 302 also includes a handle lock 2006 and a lower travel stop 2007, which engage a pivot release 2008 mounted on the rear frame 1401 adjacent the left base mounting boss 1602. The pivot release 2008 comprises a rocker arm that is pivotally mounted on a pin 2009 that protrudes from the rear frame 1401. One end of the rocker arm comprises a foot pedal 2010, which is exposed to the operator during use, and the other end of the rocker arm comprises a laterally-extending hook 2011. A leaf spring 2012 is attached to the bottom of the rocker arm to press against the rear frame 1401 and bias the hook downward when the foot pedal 2010 is not depressed. The hook 2011 is shaped such that it can contact the handle lock 2006 or lower travel stop 2007 (depending on the angular position of the base 101) when the foot pedal 2010 is not depressed.

When the rear housing 102 is in the upright storage position, the pivot release hook 2011 engages the handle lock 2006, and holds the rear housing 102 in the this position until the user depresses the foot pedal 2010 and lifts the hook 2011 out of engagement. The user can then pivot the rear housing 102 backwards to operate the device in the floor cleaning mode. Once the operator reaches a desired lower normal operating position for the rear housing 102, the hook 2011 (which is returned to its normal position by the return spring 2012) engages the lower travel stop 2007. At this point, the user can not lower the rear housing 102 any further without lifting the base 101 off of the floor. However, if even further downward pivoting is desired (or if a user desired to fold the base 101 out of the way to access the motor cover 1617 or other parts for service), the user can again depress the pivot release 2008 and move the hook 2011 out of engagement with the lower travel stop 2007 and the base 101 can then pivot even further relative to the rear housing 102.

To facilitate returning the rear housing 102 to the upright position without having to depress the foot pedal 2010, the left mounting bracket 302 also includes ramp surfaces 2013 that engage with the hook 2011 and push it upwards, against the bias of the spring 2012, and over the lower travel stop 2007 and handle lock 2006.

Referring now to FIGS. 20 and 21, in a preferred embodiment, each wheel 103 comprises a floor contacting surface 2014, a sidewall 2015, and a hubcap depression 2016, and a generally cylindrical inner flange 2017. The wheel 103 is pivotally mounted to the rear frame 1401 by its inner flange 2017. While it is possible, in one embodiment, to mount the inner flange 2017 on a cylindrical axle (not shown) that extends from the rear frame 1401, in a more preferred embodiment, the inner flange 2017 is mounted on a set of one or more bearings 2018, which are attached to bearing mounts 2019 located on the rear frame 1401 within the base mounting boss 1602. Four bearings are preferred, but other numbers may be used. The locations of the bearings are preferably selected to distribute the load of the vacuum cleaner 100 among them. In addition, since the weight of the device is always borne by the lowermost bearings 2018 (which will be the bearings located on the bottom in the upright storage position and the tilted-back use position), the relatively unloaded bearings, such as the upper forward bearing in the shown embodiment, may be replaced by simple plastic or metal bushings that are generally only used to hold the wheel 103 in position when the device is lifted off the ground. As such, combinations of bearings, bushings, and simple plastic or metal axles is envisioned with the present invention.

As shown most clearly in FIG. 21, the bearings 2018 are held in place by a wheel hub 2020, which is secured to the bearing mounts 2019 by screws 2021 or other fastening devices. The wheel hub 2020 also includes a radially extending lip 2022 that abuts, or is in close proximity to, the outer surface of the wheel's hubcap depression 2016 to thereby hold the wheel 103 on the rear frame 1401 in the axial direction. One or more low-friction rings may be located between the wheel 103 and the rear frame 1401 and/or wheel hub lip 2022 to provide a low-clearance and low-friction fit. Self-lubricating materials may also be used, as may dry of fluid lubricants, to further reduce friction and wear and the likelihood of the wheels 103 squeaking as they rotate.

The wheel assembly is completed by a hubcap 2023, which is removably secured to the wheel's hubcap depression 2016 to form a smooth outer appearance. The hubcap 2023 is preferably attached by resilient tabs 2024 that fit into corresponding slots 2025 in the wheel 103, but other attachments may be used.

Vacuum hoses (not shown) may be provided with one end adjacent each wheel 103 and/or base mounting bracket 302, 303 and another end in fluid communication with the suction side of the vacuum cleaner (such as in the bag chamber 1604 or motor inlet conduit 1618) to keep these pivoting joints free of dust and dirt, and collect any particles that are abraded from their sliding surfaces.

Figure 15:
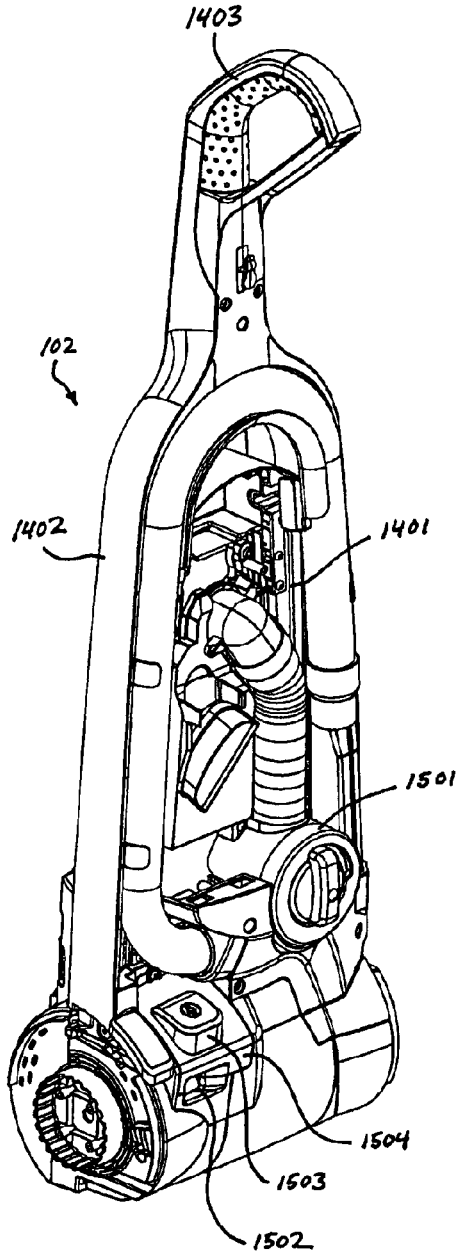
Figure 22:
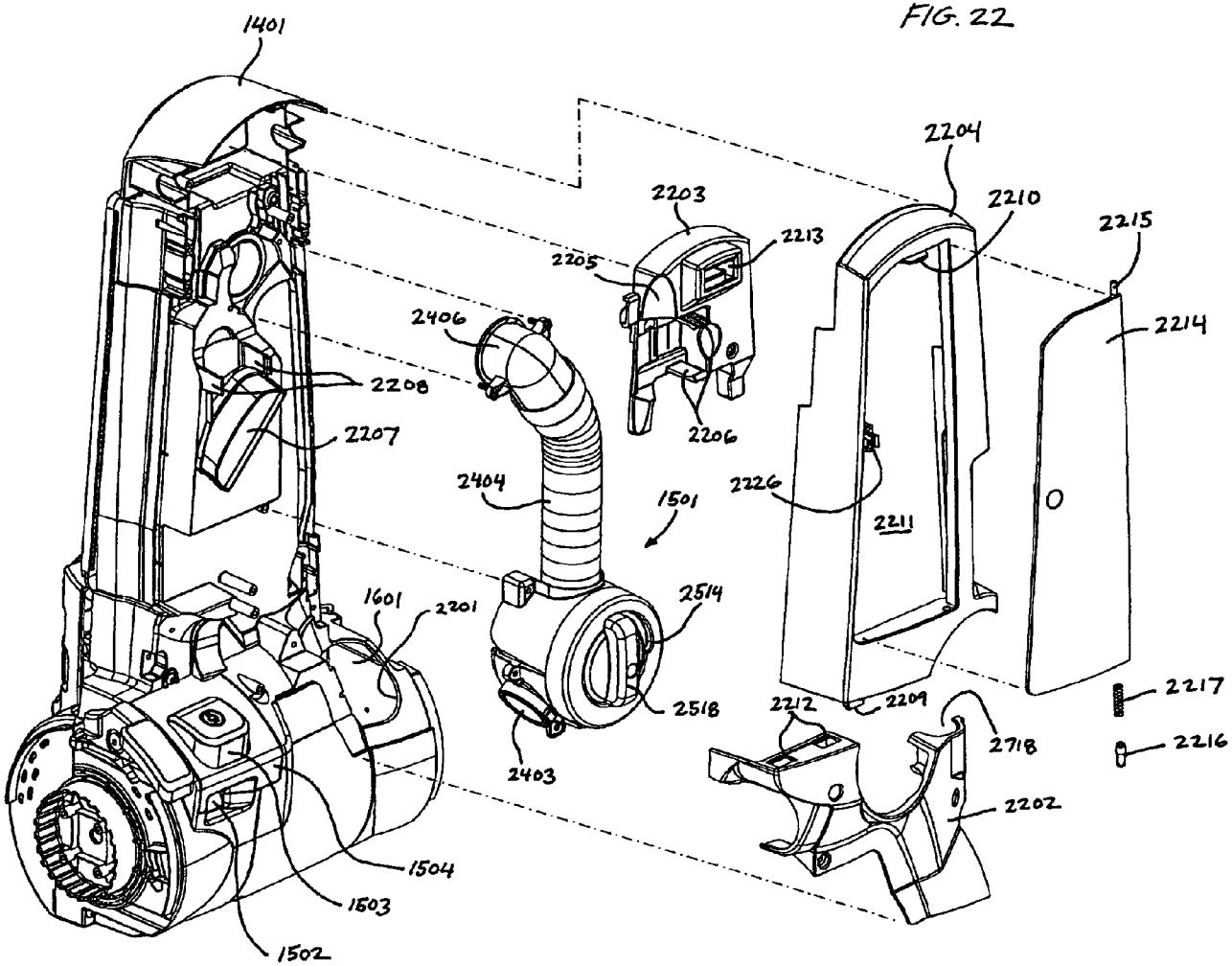
FIG. 22 is an exploded rear view of the rear housing of the embodiment of FIG. 1.

Referring now more generally to FIGS. 15 and 22, the assembly of the back of the rear frame 1401 is shown and described. As shown in FIG. 15, the rear frame 1401 has various parts attached to its back surface, including the cordreel pedal 1503 and its pedal housing 1504, which have been described previously, an accessory valve assembly 1501, and the vacuum's handle assembly 1402. It may also be desirable to store the vacuum's accessory tool on the vacuum cleaner 100 itself, and so in one embodiment, the back of the rear frame 1401 also includes a storage compartment 104 (FIG. 2).

Figure 24:
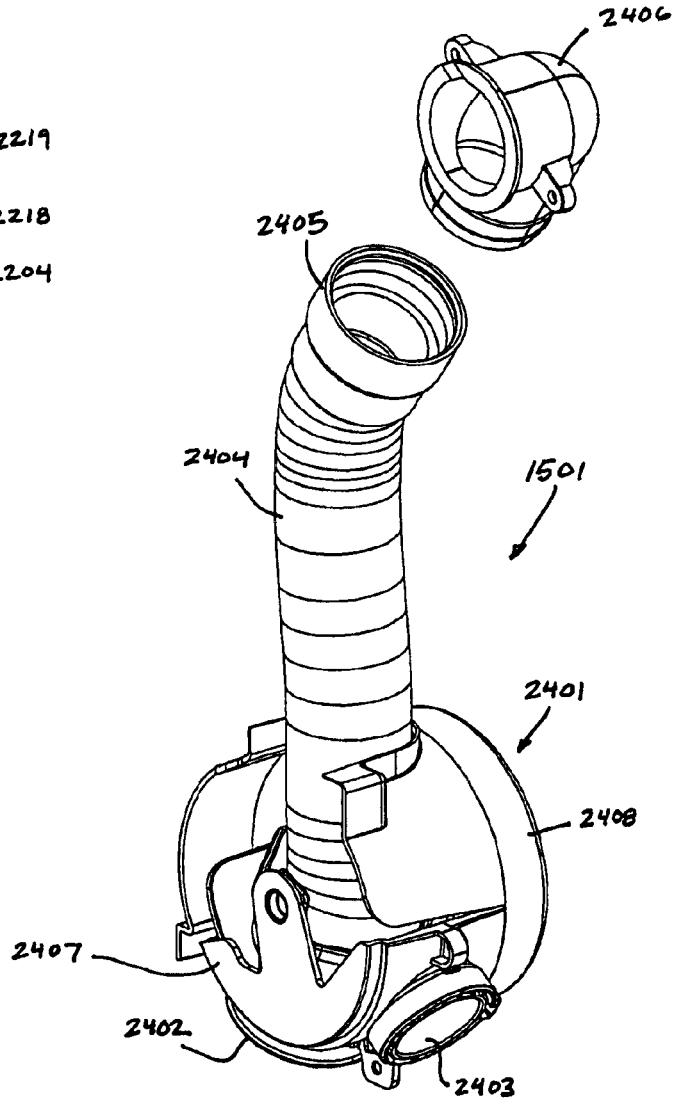
FIG. 24 is an embodiment of an accessory valve of the present invention.
Figure 25:
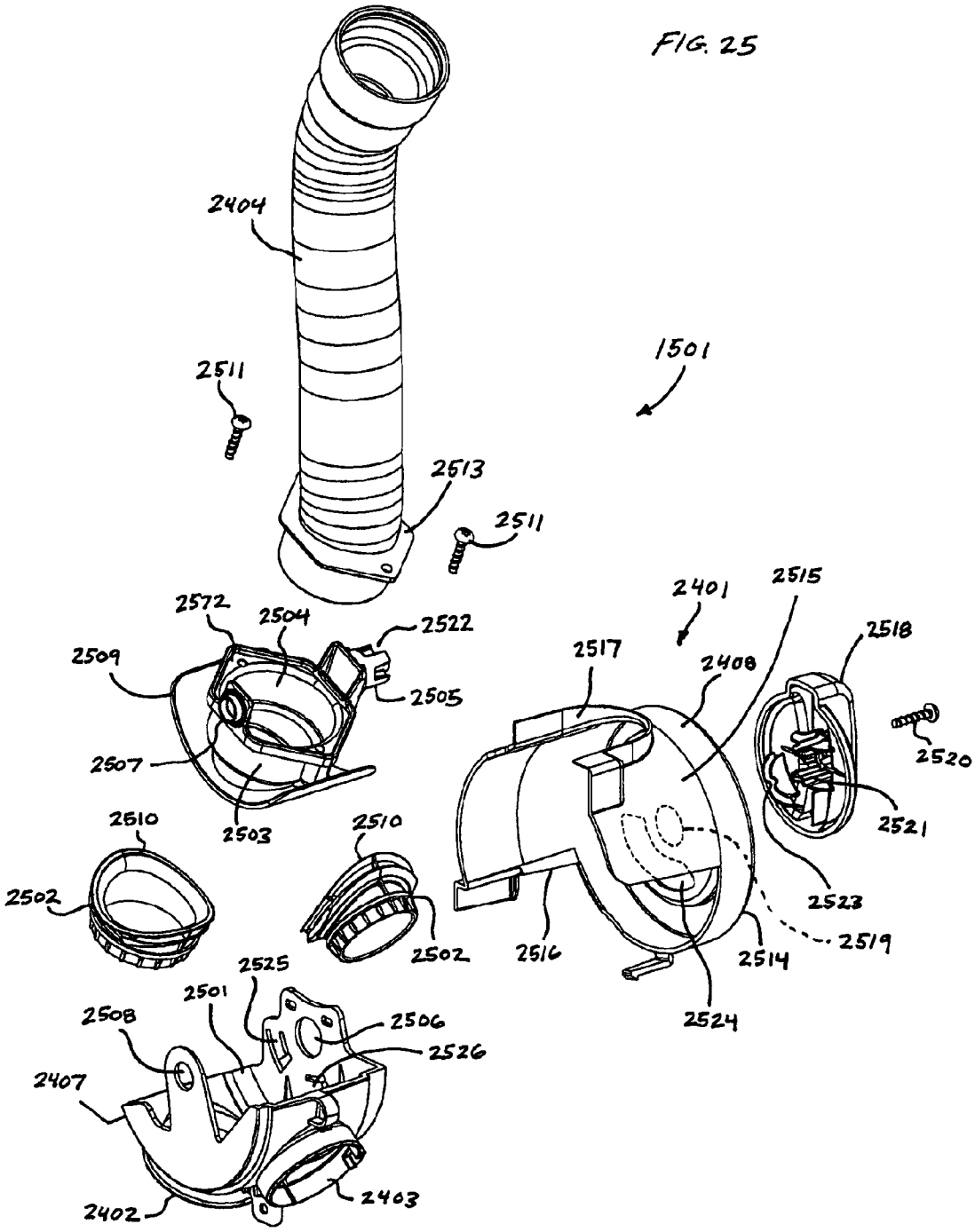
FIG. 25 is an exploded view of the embodiment of FIG. 24.
Figure 26:
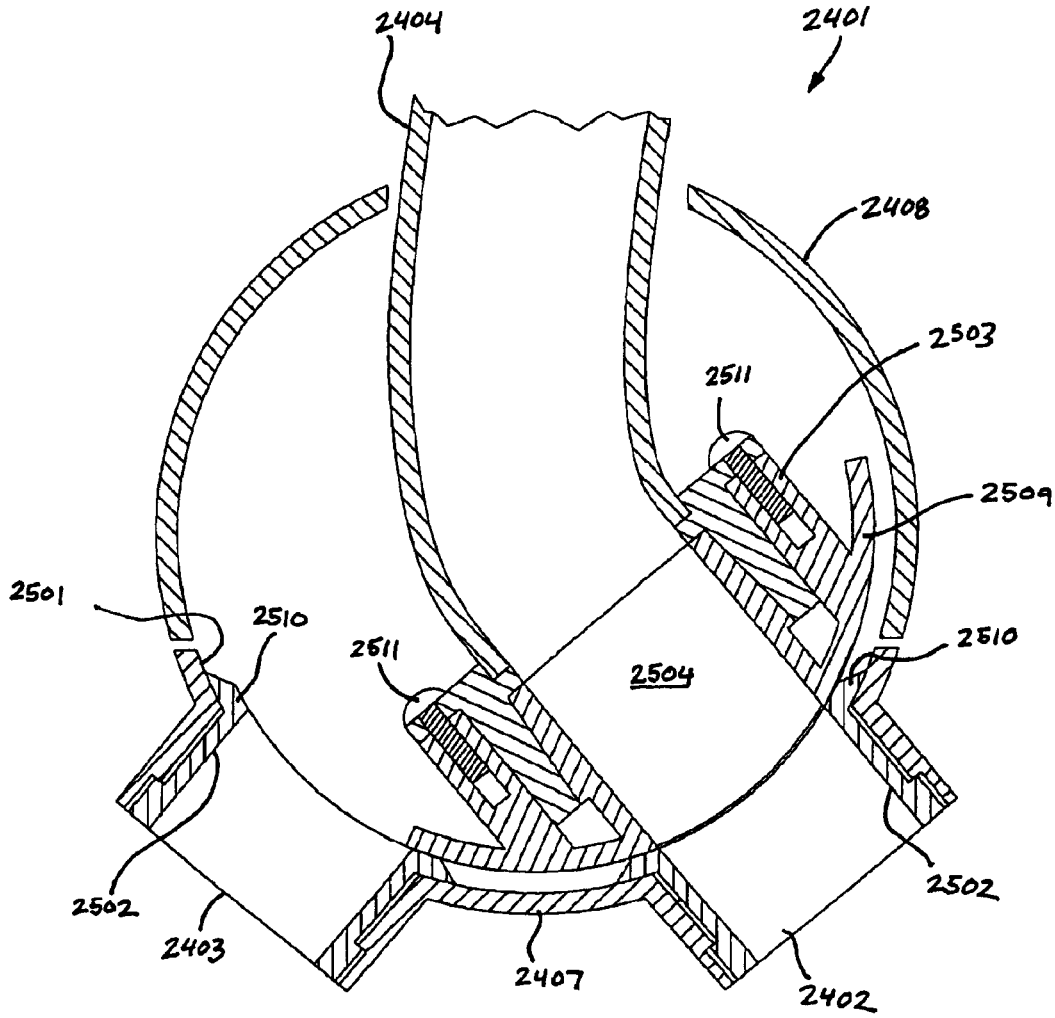
FIG. 26 is a section view of the embodiment of FIG. 24.
Figure 28:
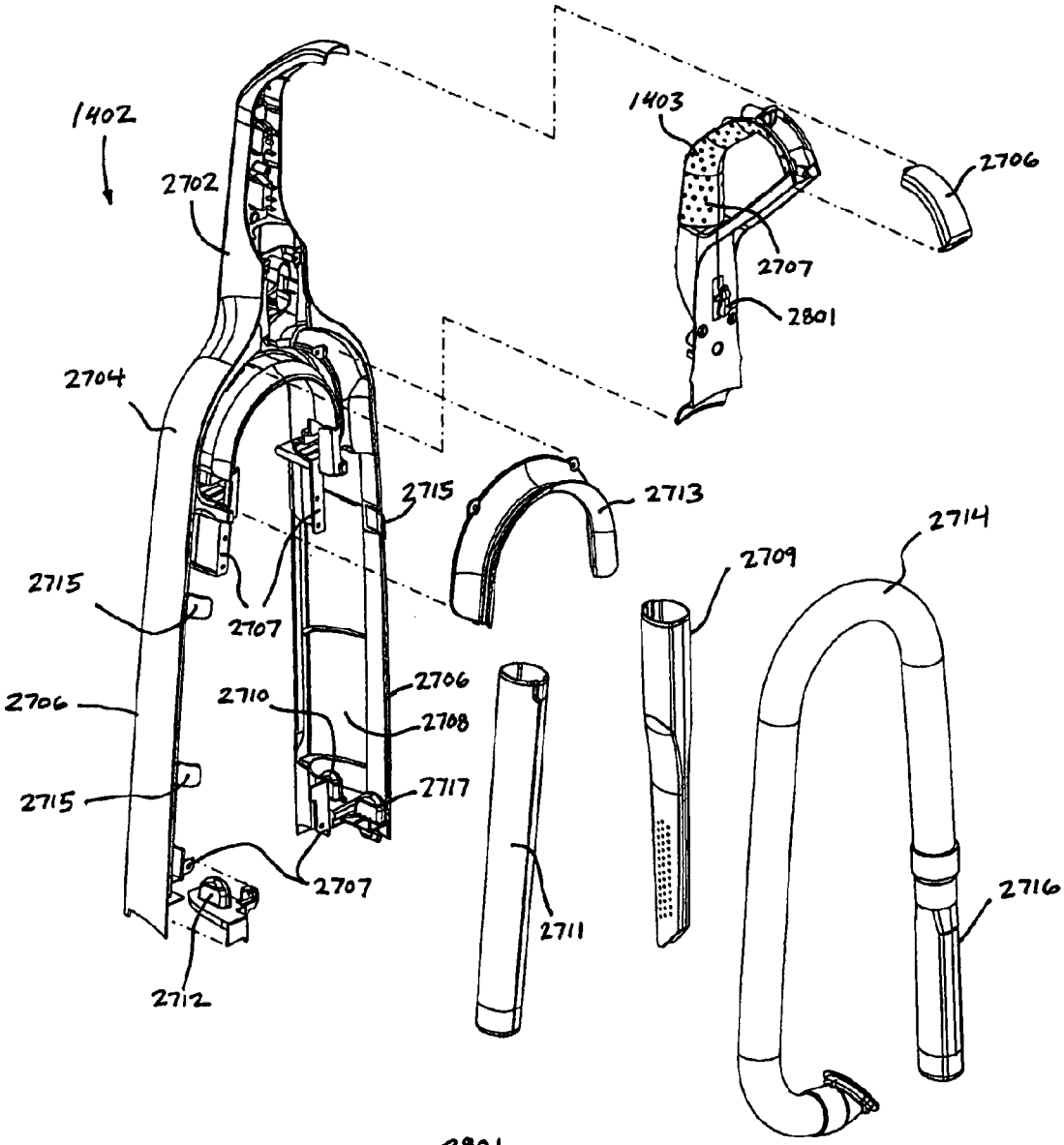
FIG. 28 is an exploded rear view of the housing assembly of the embodiment of FIG. 1.

The accessory valve 1501 is shown in more detail in FIGS. 24-26. The accessory valve 1501 generally comprises a switching arrangement 2401 having a floor inlet 2402 an accessory inlet 2403, and a flexible outlet hose 2404. The floor inlet 2402 is attached to the base hose 301 (FIGS. 3-6), and the accessory inlet is attached to the accessory hose 2714 (FIGS. 15, 27 and 28). The base hose 301 preferably extends through a hose opening 2201 (FIG. 22), which passes through the back of the rear frame 1401 to the hose slot 1601. As shown in the embodiment of FIG. 25, the floor inlet 2402 is slightly larger than the accessory inlet 1004, to reduce the suction applied to accessory tools connected to the accessory inlet 1004, but this construction is not required. The outlet hose 2404, which maybe opaque or transparent, leads from the switching arrangement 2401 to an outlet 2405. The outlet 2405 is attached by a friction fit, bayonet fittings, or by other means, to a connector 2406, which is attached to the rear frame 1401 to be in fluid communication with the bag inlet pipe 1635 (FIG. 16). The connector 2406 preferably comprises a clear plastic material with gentle internal bends to facilitate detection of clogs. Any clogs can be readily removed by disconnecting either the connector 2406 from the rear frame 1401, or the outlet 2405 from the connector 2406. The connector 2406 can be fixed in place by screws or other tool- or hand-operable fastening devices.

The switching arrangement 2401 includes a first switch housing member 2407 and a second switch housing member 2408 that are detachably connected to one another, such as by snap engagement, fasteners, or other means, or may be unattached but held in their respective positions by separate attachment to the rear frame 1401. The first and second switch housing members 2407, 2408 are attached to the back of the rear frame 600 by screws (not shown), snap engagement, or other fasteners. It will also be appreciated that either or both of the first and second switch housing members 2407, 2408 may be formed integrally with one another or with other parts of the vacuum cleaner housing, and it is not strictly required to provide them as separate parts.

As shown in FIG. 22, a cover plate 2202 is attached to the rear frame 1401 below the switching arrangement 2401. The cover plate 2202 covers the connections between the hoses and the accessory valve 1501, and may include internal ribs that hold the hoses 301, 2714 in place. In this way, the hoses 301, 2714 can be disconnected from the accessory valve 1501 simply by removing the cover plate 2202. The cover plate 2202 also preferably covers the hose opening 2201 and completely conceals the base hose 301 from view during normal operation. In this way, the base hose 301 is entirely concealed within the base 101 and rear housing 102 during normal use, which protects the base hose 301 from damage, and provides an aesthetically pleasing appearance.

The first switch housing member 2407 has a generally arcuate inner surface 2501 in which the floor and accessory inlets 2402, 2403 are formed. Each inlet 2402, 2403 has a seal 2502 associated with it. The seals 2502 comprise any suitable rubber or synthetic sealing material. While the seals 2502 are shown as separate members, they may be joined to one another, or may be integrally molded (such as by two-shot molding or overmolding) into the first switch housing member 2407. The seals 2502 may optionally be omitted.

A switch hose connector 2503, which has a hose connector passage 2504 forming a fluid conduit through it, is pivotally mounted within the first switch housing member 2407. As can be seen in FIG. 26, the switch hose connector 2503 is adapted to pivot between a floor cleaning position (shown), in which it connects the floor inlet 2402 with the outlet hose 2404, and an accessory cleaning position, in which it connects the accessory inlet 2403 with the outlet hose 2404. Suitable travel stops (not shown) may be provided to prevent any further pivoting beyond these positions. The switch hose connector 2503 may be pivotally mounted in any suitable manner. In a preferred embodiment, the switch hose connector 2503 has a first generally cylindrical protrusion 2505 that fits into a corresponding first hole 2506 in the first switch housing member 2407, and a second generally cylindrical protrusion 2507 that fits into a corresponding second hole 2508 in the first switch housing member 2407. The first and second protrusions and holes are sized so that the switch hose connector 2503 can not be inserted in the wrong direction. In the shown embodiment, the switch hose connector 2503 is installed by flexing the first switch housing member 2407 until it is possible to insert the switch hose connector 2503 between the holes 2506, 2508, then releasing it to capture the protrusions 2505, 2507 within the holes 2506, 2508. Lubricants, bearings, bushings, self-lubricating materials, or other friction-reducing devices may also be used to help create a smooth pivoting arrangement between these parts.

The switch hose connector 2503 also includes a sealing surface 2509 that is located such that it contacts or nearly contacts the lips 2510 of the seals 2502, as shown in FIG. 26. To this end, the sealing surface 2509 is formed as an arced surface that generally follows the contour of the arcuate inner surface 2501 of the first switch housing member 2407. The switch hose connector passage 2504 passes through the sealing surface 2509 to a hose mounting boss 2512. The sealing surface 2509 is preferably sized such that it always maintains at least some contact with both seals 2502, as shown in FIG. 26, which provides a vacuum seal and helps prevent the sealing surface 2509 from catching on the seal lips 2510. While it is preferred to position the seals 2502 in or around the two inlets 2402, 2403, the seals 2502 may be removed, or replaced by a single seal located on the sealing surface 2509 around the passage 2504.

The outlet hose 2404 is connected to the switch hose connector 2503 by screws 2511 that thread into the hose mounting boss 2512, but any other permanent or detachable attachment method may be used. In the shown embodiment, the outlet hose 2404 includes a flange 2513 that abuts the hose mounting boss 2512. The flange 2513 and/or mounting boss 2512 may include gaskets, labyrinth seals, or other sealing devices to reduce the likelihood of a vacuum leak at their juncture.

As noted before, the second switch housing member 2408 is attached to the first switch housing member 2407. The second switch housing member 2408 covers the switch hose connector 2503, and generally comprises a disk-like front face 2514 and a shroud portion 2515 that extends from the face 2514 to cover the moving parts of the switching arrangement 2401. The shroud portion 2515 has a first cutout 2516 into which the first switch housing member 2407 fits, and a second cutout 2517 through which the flexible outlet hose 2404 passes.

A switch handle 2518 is mounted to the switch hose connector 2503 through a hole 2519 in the face 2514 of the second switch housing member 2408, and secured with a screw 2520 or other fastener. The switch handle 2518 includes projections 2521 that fit within corresponding slots 2522 in the first protrusion 2505 to rotationally lock the handle 2518 to the switch hose connector 2503. The switch handle 2518 also includes one or more ribs having notches 2523 located thereon. These notches 2523 pass through an arcuate slot 2524 in the second switch housing member face 2514 and engage corresponding projections (not visible) located on cantilevered portions 2525, 2526 of the first switch housing member 2407. The notches 2523 engage the first cantilevered projection 2525 when the switch hose connector 2503 is turned with the hose connector passage 2504 fluidly connecting the floor inlet 2402 with the outlet hose 2404 (the floor cleaning position), and the notches 2523 engage the second cantilevered projection 2526 when the switch hose connector 2503 is turned with the hose connector passage 2504 connecting the accessory inlet 2402 with the outlet hose 2404 (the accessory cleaning position). In each of these positions, the engagement between the notches 2523 and the cantilevered projections 2525, 2526 resiliently holds the switch handle 2518 in place. This provides a tactile indicator when the switch hose connector 2503 is in each of its two operating positions, and prevents it from inadvertently rotating out of position.

While the foregoing switching arrangement is preferred, numerous variations of this aspect of the invention may also be practiced and are within the scope of the present invention. For example, in one alternative embodiment, the switch hose connector is a sliding member, rather than a pivoting member. In this embodiment, the first switch housing member is provided with a flat surface that holds the floor and accessory inlets, and the handle is replaced by a lever or slider. Other variations will be apparent to those of ordinary skill in the art based on the teachings herein.

The present invention also includes an accessory tool storage compartment 104 (FIG. 2), which is formed on the back of the rear frame 1401. The storage compartment 104 is adapted to hold, and preferably conceal, one or more accessory tools, such as carpet brushes, crevice tools, lint brushes, and so on, as are known in the art. As shown in FIG. 22, the storage compartment 104 comprises an inner panel 2203 and a compartment cover 2204, which are attached to the back side of the rear frame 1401. The inner panel 2203 (which, if desired, may be integrally formed with the rear frame 1401, rather than being supplied as a separate part) includes a first tool mounting indentation 2205, having a first set of tool mounting clips 2206. A second tool mounting indentation 2207 is formed on the back surface of the rear frame 1401, and includes a second set of tool mounting clips 2208. The indentations 2205, 2207 preferably are shaped to approximate the shape of the tools that belongs in them, which assists the user with storing the parts in the proper place. The clips 2206, 2208 comprise flexible protrusions into which the tools fit by firm but releasable snap engagement.

The compartment cover 2204 fits over the portion of the rear frame 1401 having the tool mounts 2205, 2207, to provide the device with a neater and more aesthetically pleasing appearance. The compartment cover 2204 also conceals the accessory switch outlet hose 2404. The compartment cover 2204 is attached to the rear frame 1401 by downwardly-extending lower tabs 2209 that protrude from the bottom of the compartment cover 2204, and a flexible snap tab 2210 that is located just inside a cover opening 2211. The lower tabs 2209 slidably engage a pair of slots 2212 on the cover plate 2202 (or on the rear frame 1401 itself), and the snap tab 2210 fits into a slot 2213 on the inner panel 2203 (or rear frame 1401). The snap tab 2210 comprises a flexible arm having one or more hooks that engage corresponding surfaces in the slot 2213 to releasably hold the compartment cover 2204 in place. Such snap tabs are known in the art. Of course, other attachment methods may be used, such as screws or other fasteners.

A cover door 2214 is attached to the compartment cover 2204 to selectively close the opening 2211. In a preferred embodiment, the cover door 2214 is pivotally attached to the compartment cover 2204 on a vertical pivot axis that extends between a fixed upper pivot 2215, and a slideable lower pivot 2216, which fit in respective holes in the compartment cover 2204. A coil spring 2217 is provided to act in torsion to automatically bias the door 2214 into the closed position.

Figure 23:
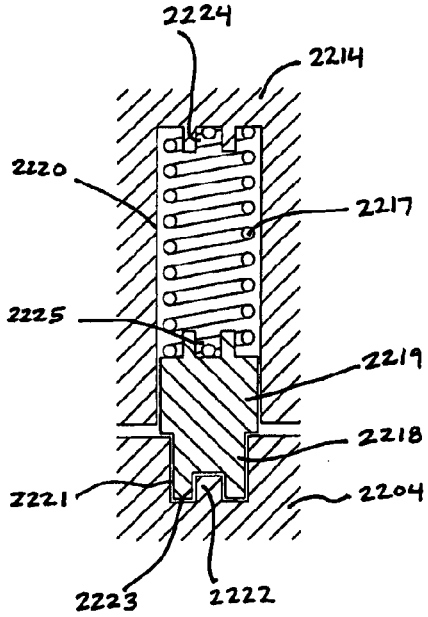
FIG. 23 is a section view of the lower pivot arrangement of the embodiment of FIG. 22.

As shown in more detail in FIG. 23, the lower pivot 2216 comprises a pin having a relatively thin lower end 2218, and a thicker upper end 2219. The lower pivot 2216 is assembled by inserting the spring 2217 into a first hole 2220 in the door 2214, followed by the lower pivot 2216. Once this is done, the upper door pivot 2215 is inserted into a hole (not shown) at the top of the cover opening 2211, and the lower pivot 2216 is guided over a lower hole 2221 and released. Once released, the spring 2217 pushes the lower pivot 2216 into the lower hole 2221. The lower hole 2221 includes a protrusion 2222 that fits into a notch 2223 on the bottom of the lower pivot 2216, to thereby prevent the lower pivot from rotating relative to the compartment cover 2204. Similarly, the first hole 2220 and the top of the lower pivot 2216 each include notches 2224 and 2225 into which the ends of the spring 2217 fit, so that the ends of the spring can not rotate relative to these parts. As such, when the cover door 2214 is opened, which causes the notch 2224 to rotate, the spring 2217 is placed under a torsional load because its lower end is locked in the lower pivot 2216 and can not rotate. This generates a restoring force that biases the spring 2217 back to its relaxed position, and the door 2214 into the closed position.

A door latching arrangement is also provided to hold the cover door 2214 in the closed position. The latching arrangement comprises a barbed post 2703 (FIG. 27) that fits into a snap 2226 that opens and closes on alternate pushes, as are known in the art. Of course, any other pivoting and latching arrangements can be used for the cover door 2214, as will be understood by those of ordinary skill in the art in view of the present disclosure.

Referring now to FIGS. 27 and 28, the handle assembly 1402 of the present invention is shown and described in more detail. The handle assembly 1402 generally comprises an arched handle frame 2704 to which an upper grip post 2702 is attached.

In a preferred embodiment, the grip post 2702 includes one or more vacuum controls that can be used to operate and adjust the vacuum cleaner 100. Although any types of controls may be used, it is preferred for the controls to comprise an on/off switch 2705, and a height adjustment control 2701. The power switch 2705 may be a conventional switch that turns on the fan/motor 1603 and the brushroll motor 752, and preferably has a first position in which only the fan/motor 1603 is activated, and a second position in which both the fan/motor 1603 and brushroll motor 752 are activated. The power switch 2705 may also be connected to circuitry that disables the fan/motor 1603 and/or brushroll motor 752 during fault conditions, such as the thermal cutoff device 1619 described above. Additional circuitry may be used to disable the brushroll motor 752 when the accessory cleaning mode is activated. For example, the accessory valve 1501 may have an electric cutoff switch that disables the brushroll motor 752 when it is placed in the accessory cleaning position, or the rear housing 102 may have such a switch that is activated when it is placed in the upright position.

The height adjustment control 2701 preferably comprises a rocker switch that is electrically attached to a motorized height adjustment assembly 705, as described above with reference to FIGS. 7 and 10, and can be moved in one direction to raise the base, and in another direction to lower the base.

The grip post 2702 includes a grip 1403, which may be integrally formed with the grip post 2702, or formed as one or more separate parts, as shown. In the shown embodiment, the grip 1403 is provided as a separate molding and attached to the back of the grip post 2702. A cap 2706 may also be provided to improve the cosmetic appearance of the device. This construction facilitates concealment of the wires leading to the controls 2705, 2701 within the grip post 2702. The grip 1403 may be provided with a textured and/or tactile grip overmolding 2707 to improve the user's grip and accentuate the aesthetic feel of the device.

Figure 29:
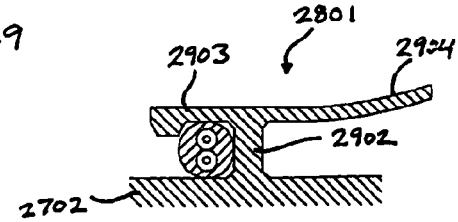
FIG. 29 is a section view of an embodiment of a cord retainer clip of the present invention.
Figure 30:
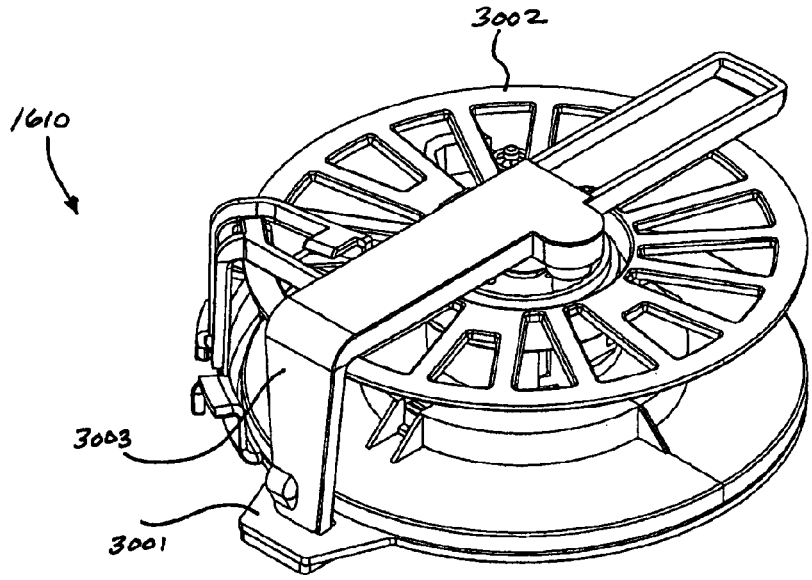
FIG. 30 is an isometric view of an embodiment of a cordreel of the present invention.

As shown in FIGS. 1, 28 and 29, the back of the grip post 2702 also includes a cord retainer clip 2801, which is shown in more detail in FIG. 29. The cord retainer clip 2801 is provided to hold the power cord 2901 adjacent the grip 1403, which is sometimes desirable to prevent the cord from becoming entangled with the vacuum's base 101 during operation. The retainer clip 2801 may be of any conventional construction, but preferably comprises a T-shaped protrusion having a base 2902, a grip arm 2903 that is shaped to firmly receive a power cord, and a release arm 2904 that extends opposite the grip arm 2903. The release arm 2904 serves as a lever that can be pressed towards the grip post 2702 to move the grip arm 2903 away from the grip post 2702. This useful feature allows the user to use lever action to insert and release the power cord 2901 from the grip arm 2903. Not only does this make this process easier than with many known designs, but it also allows the grip arm 2903 to be provided with a smaller diameter to more aggressively grip the power cord 2901. The release arm 2904 is preferably provided with an enlarged surface, as shown, to facilitate its operation, and ensure that it is not uncomfortable to press it towards the grip post 2702.

The grip post 2702 and grip 1403 may be attached directly to the top of the rear frame 1401, as known in the art, but it is preferred for these parts to be attached to a handle frame 2704 that comprises two legs 2706 that generally form an arch. The legs 2706 fit over and around the rear frame 1401, and are attached at various points 2707 by fasteners, such as snaps, screws (not shown), and so on. Each leg includes a hollow interior space 2708, which is adapted to hold one or more accessory tools. For example, in the shown embodiment, one leg 2706 is adapted to receive a crevice cleaning tool 2709 on a stub post 2710 at its lower end, and by snap engagement with the inner surface of the interior space 2708 at its upper end. The other leg 2706 receives an extension pipe 2711 on another stub post 2712 at its lower end, and by snap engagement at its upper end.

The handle frame 2704 also includes a hose hoop 2713 comprising an arcuate channel having a concave profile, which preferably matches the outer diameter of an accessory hose 2714. The hose hoop 2713 is attached to (or formed with) the upper portion of the handle frame 2704, and preferably is at least partly nested between the legs 2706. The accessory hose 2714, which is attached to the accessory inlet 2403 of the accessory valve 1501, fits over the hose hoop 2713, and preferably at least partially within the legs 2706. One or more hose tabs 2715 may be provided to slightly envelop the accessory hose 2714 to help retain it in place. The free end of the accessory hose 2714 optionally terminates at a rigid pipe 2716, which also fits within one of the legs 2706, and is secured in place by a stub post 2717. As shown in Figure R6, the cover plate 2202 covering the lower part of the rear frame 1401 may also include a cutout 2718 into which the rigid pipe 2716 fits to further help retain it in place.

This preferred handle assembly 1402 construction provides convenient concealed storage of both the accessory hose 2714, and various accessory tools, such as a crevice tool 2709 and an extension pipe 2711. The use of the deeply profiled legs 2706 allows various accessory tools 2709, 2711 to be concealed behind the accessory hose 2714, but still readily accessible whenever necessary, and is also believed to add strength and torsional rigidity to the handle.

Referring now to FIGS. 30-33, the present invention also provides a retractable cordreel 1610, which may be used in upright vacuum cleaners (as shown herein), or in other types of devices and appliances, such as canister vacuums. The cordreel 1610 generally comprises a mounting plate 3001 that is rigidly mounted to or captured within the vacuum cleaner housing, and a spool 3002 that is rotatably mounted on the mounting plate 3001.

The spool 3002 comprises a generally cylindrical central hub 3201 (FIGS. 32 and 33), to which first and second generally radially-extending flanges 3202, 3203 are attached to form a cord holding region 3204 (FIG. 33) therebetween. The central hub 3201 includes a central bore 3205 that fits over an axle 3206 that protrudes from the mounting plate 3001, to thereby form a pivoting mount for the spool 3002. A portion of the central hub 3201 is formed by a removable terminal block 3207. One end of the power cord (not shown) is attached to the terminal block 3207 with its two electrical leads 3301 attached to corresponding sliding electric contact terminals 3302 (only one lead and contact are visible in FIG. 33). When installed in the central hub 3201, the terminal block 3207 forms a generally circular surface upon which the power cord winds when the spool 3002 is rotated. The terminal block 3207 also clamps down on the power cord to hold it against accidental removal.

Figure 31:
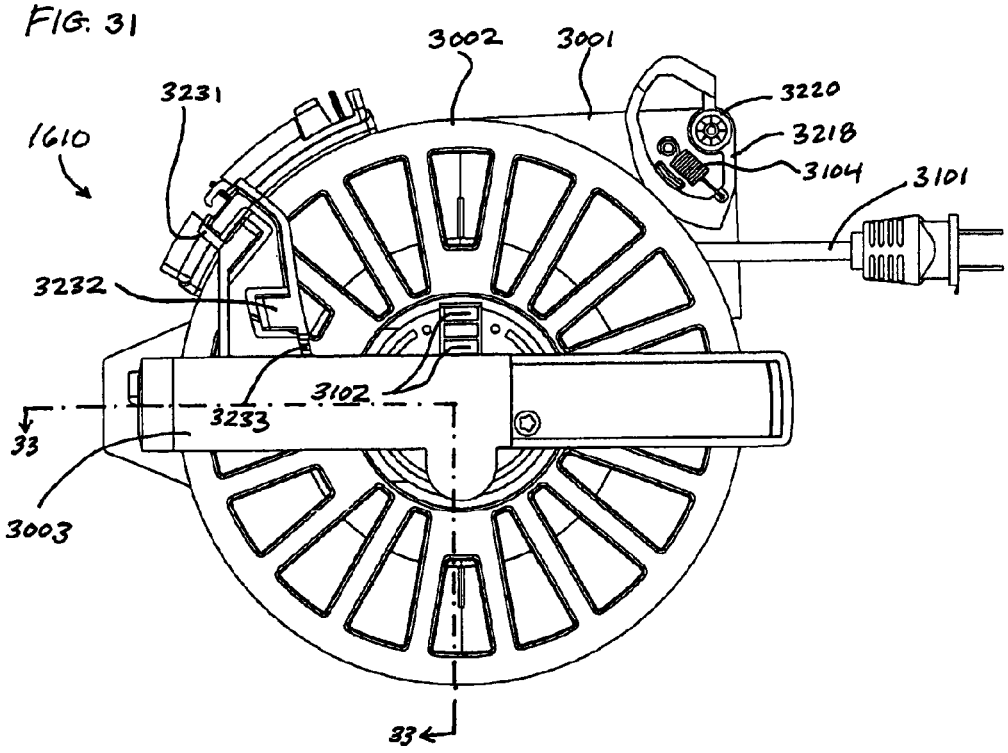
FIG. 31 is a side view of the embodiment of FIG. 30.

The spool 3002 is retained on the axle 3206 by a terminal ring plate 3208, which has two concentric terminal rings 3209. The terminal ring plate is retained by a screw 3303 or other fastening arrangement, and has a tab (not shown) that fits into a notch 3211 on the end of the axle 3206 to keep it from rotating. The rings 3209 are electrically isolated from one another and each is attached to (or formed with) a separate terminal 3102 (FIG. 31). Each ring 3209 is in contact with a corresponding contact terminal 3302 on the terminal block 3207 throughout the rotation of the spool 3002, to thereby receive power from the power cord when it is plugged into a wall outlet or other power source. Power leads (not shown) to the rest of the vacuum cleaner are attached to the terminals 3102 to power the device.

The first flange 3202 is generally flat, and provided with numerous slots 3210 to ventilate the cordreel. The second flange 3203 is stepped at two locations. The first step is formed by a first axially-extending wall 3212. Wall 3212 extends away from the central hub 3201 and forms a flat, cylindrical chamber 3304 that is sized to receive a coiled flat spring assembly 3213. The spring assembly 3213 is affixed to the first axial wall 3212 by hooking it into one or more slots 3214 in the wall 3212, and is attached to the axle 3206 at one or more axle splines 3215. In this manner, the spring assembly 3213 is extended when the spool 3002 is unwound, and provides a restoring force to retract the cord.

The second flange 3203 is stepped again at a second axial wall 3216, which also extends away from the central hub 3201. The second axial wall 3216 is positioned to circumferentially encase a corresponding fixed wall 3217 on the mounting plate 3001, to thereby form a tortuous path that inhibits dirt from entering the inner parts of the cordreel 1610. The second axial wall 3216 also forms a surface for contacting the spool brake 3218, as described below. A felt seal or other sealing mechanism may be provided at this location, or elsewhere, to further seal the cordreel 1610 against dirt and dust.

The cordreel 1610 includes a spool brake 3218, which is pivotally mounted on a pin 3219 on the mounting plate 3001. A push nut 3220 is provided to hold the spool brake 3218 on the pin 3219. As best shown in FIG. 31, the spool brake comprises a cam-shaped device, preferably formed of a somewhat flexible and tactile material, that contacts the second axial wall 3216 of the spool 3002. When the cordreel is retracted by the spring 3213, (counter-clockwise in FIG. 31), contact between the second axial wall 3216 and the cam-shaped spool brake 3218 tends to press the spool brake 3218 into the second axial wall 3216 to hold the spool 3002 in place. The spool brake 3218 is released by pressing down on its protruding actuation surface 3103 and rotating it counter-clockwise to take it out of contact with the second axial wall 3216. A spring 3104 is provided to return the spool brake 3218 to contact the second axial wall 3216 and lock the spool 3002 from retracting when the actuation surface 3103 is released. The actuating surface 3103 may simply protrude outside the rear frame 1401 to be operated directly by the user, or it may be operated by intermediary parts. In a preferred embodiment, the actuating surface 3103 is operated by a foot pedal 1503, which is shown in FIGS. 20 and 22.

Figure 33:
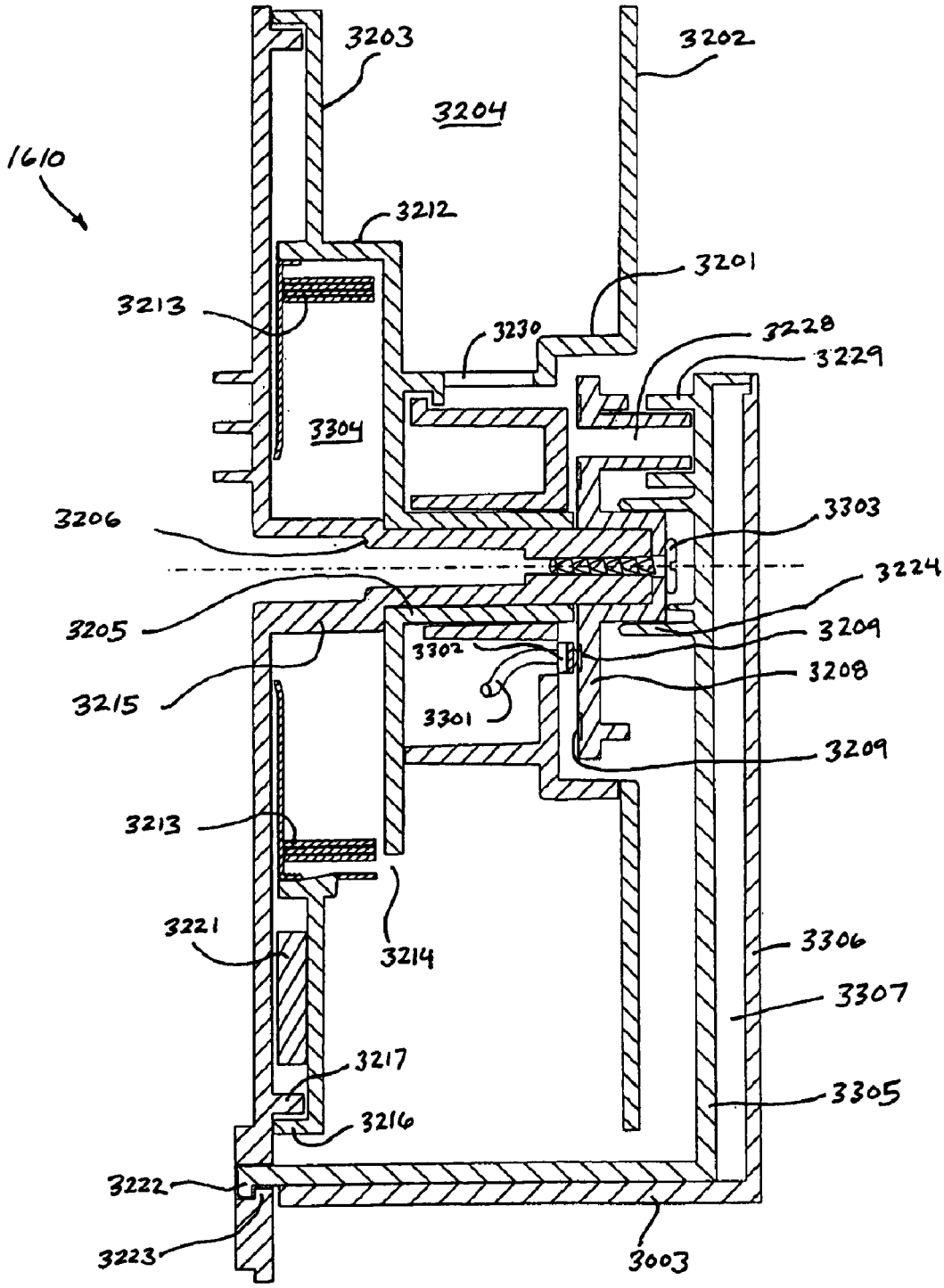
FIG. 33 is a section view of the embodiment of FIG. 30, as shown along reference line 33-33 of FIG. 30.

The cordreel 1610 is also provided with an inertia brake 3221 that helps prevent the spool 3002 from retracting too rapidly. The friction brake 3221 comprises a curved member, preferably metal or plastic, that is pivotally mounted on a pin (not shown) on the surface of the spool 3002 that faces the mounting plate 3001. The friction brake 3221 normally rests loosely in the annular space between the outer surface of the first axial wall 3212 (which extends somewhat beyond the second flange 3203, as shown in FIG. 33), and the inner surface of the fixed wall 3217 of the mounting plate 3001. However, when the spool is rapidly retracted, the inertia brake 3221 swings outward, urged by centripetal force, and contacts the fixed wall 3217. The force of this contact depends on the speed of rotation, and thus it acts as a self-regulating speed brake.

The cordreel 1610 also includes a bracket arm 3003, which can be used to help mount the cordreel 1610, and which carries the cordreel electrical wires (not shown) and cooling hose (not shown). As shown in FIG. 33, the bracket arm 3003 is formed by adjacent inner and outer members 3305, 3306, which together form a hollow passage 3307 through a portion of the arm 3003. The bracket arm 3003 is attached to the mounting plate 3001 at one end by a hook 3222 that fits into a corresponding slot 3223 in the mounting plate 3001. The bracket arm 3003 also includes a circular pocket 3224 that fits over the end of the terminal ring plate 3208 and its mounting screw 3303. A screw 3225 is provided to pass through the bracket arm 3003 and into a threaded boss 3226 on the terminal ring plate 3208 to hold the bracket arm 3003 in place, and more securely retain the spool 3002 on the mounting plate 3001. The end of the inner member 3305 extends past the outer periphery of the spool 3002, and has a slot 3227 at its end to provide a convenient mounting point, if such is desired.

Figure 32:
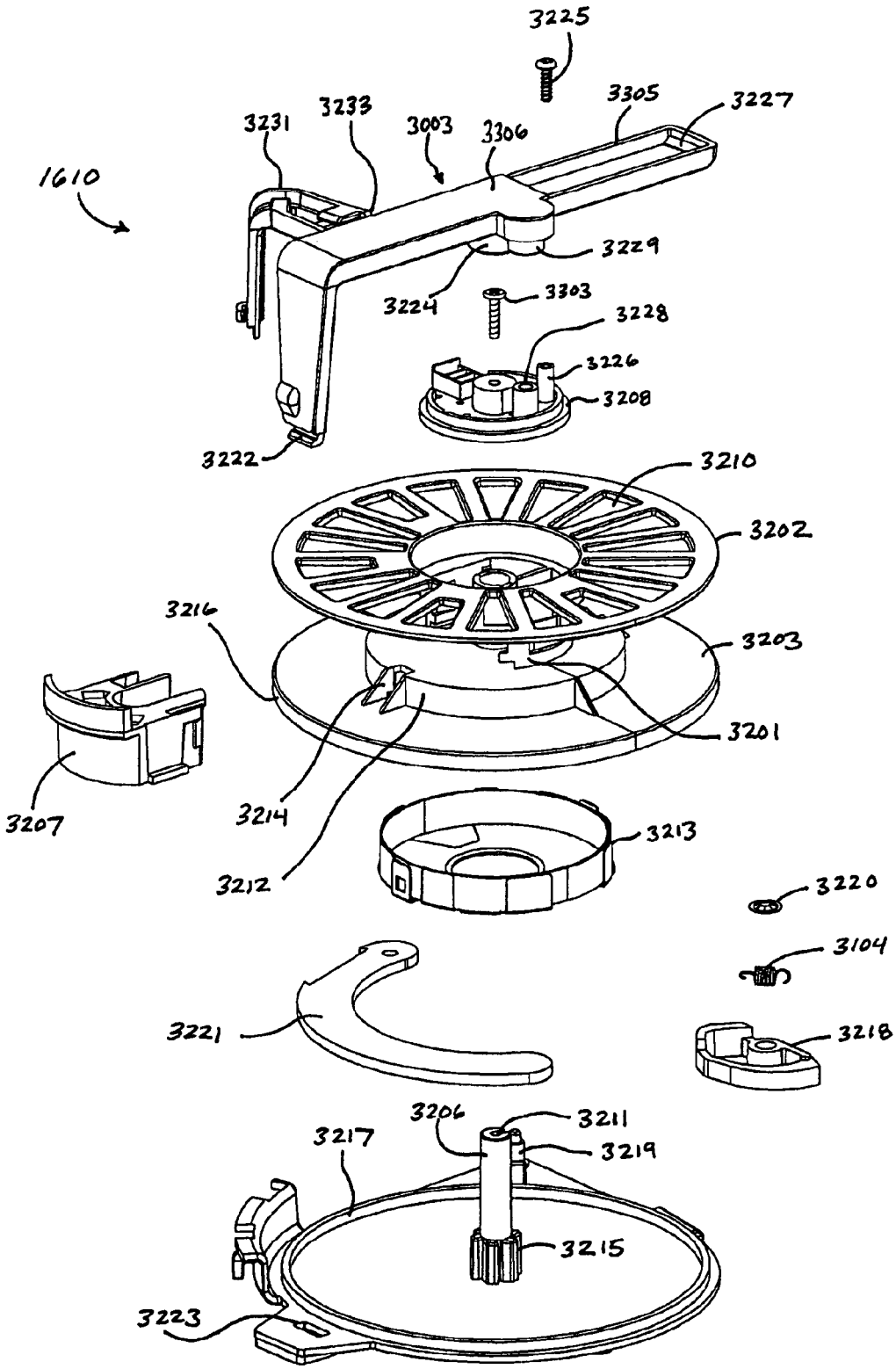
FIG. 32 is an exploded view of the embodiment of FIG. 30.

Cordreels often generate heat during use, and may be heated by adjacent parts, such as vacuum fan motors. As such, the cordreel of the present invention also includes a cooling system that uses the fan/motor 1603 to draw air through the central hub 3201 and over the electrical contacts 3302, 3209. As shown in FIGS. 32 and 33, the terminal ring plate 3208 includes a vacuum port 3228 that passes entirely through the terminal ring plate 3208 to allow air communication therethrough. When assembled, the vacuum port 3228 inserts into a receiving boss 3229 on the bracket arm 3003, which leads to the hollow passage 3307. A cordreel-cooling vacuum hose 1611 (FIG. 16) is attached to the hollow passage 3307 and to the fan/motor 1603, such as by being placed in fluid communication with the bag chamber 1604 or motor inlet conduit 1618 upstream of the fan/motor 1603 or pre-motor filter (if one is used). Thus, the suction created by the fan/motor 1603 generates an air flow through the vacuum port 3228 that draws air through the cordreel 1610 to cool it. The cooling air flow may pass solely across the terminals 3302, 3209, or may also pass through the terminal block 3207 or through cooling holes 3230 (FIG. 33) in the central hub 3201 to directly cool the coiled power cord. Other cooling airflow arrangements can be made by selectively providing holes, slots, or other air flow allowing apertures, as will be apparent to those of ordinary skill in the art in view of the present disclosure.

The bracket arm 3003 may also include an auxiliary arm 3231 that extends around the spool 3002 and terminates adjacent to the mounting plate 3001. The auxiliary arm 3231 has one or more vacuum hose clips 3232, and one or more wire clips 3233 that hold the cordreel-cooling vacuum hose 1611 and power wires in position. The auxiliary arm 3231 may also help stabilize the cordreel 1610.

While the embodiments described herein are preferred, these are not intended to limit the scope of the invention. Furthermore, the various inventions disclosed herein are not required to be practiced in conjunction with one another. Many additional variations on the embodiments herein will be apparent to those of ordinary skill in the art in view of the present disclosure and with practice of the invention. These and other variations are within the scope of the present invention, which is limited only by the appended claims.

We claim:

1. A vacuum cleaner comprising:

a dirt receptacle;

an exhaust chamber;

a vacuum fan adapted to create a flow of air from the dirt receptacle, through the vacuum fan, and into the exhaust chamber;

a grate covering the exhaust chamber and having an inner surface defining a first side of the grate, an outer surface facing opposite the inner surface and defining a second side of the grate, one or more air passages extending from the inner surface to the outer surface, and an outer perimeter wall defining the peripheral edge of the grate; and a flexible cover wrapped around the grate from the outer surface to the inner surface, the flexible cover having:

a first portion located on the second side of the grate, extending over at least one of the one or more air passages and positioned over at least a portion of the outer surface, a second portion extending from the first portion, the second portion extending from the outer surface to the inner surface to wrap, in a direction extending from the outer surface to the inner surface, entirely around at least a portion of the outer perimeter wall, and a third portion located on the first side of the grate and extending from the second portion to be positioned over at least a portion of the inner surface to thereby lie in a space that is perpendicular to the inner surface.

2. The vacuum cleaner of claim 1, wherein the exhaust chamber comprises an air-impermeable surface adapted to form a portion of a bag chamber and one or more sealing surfaces surrounding the air-impermeable surface.

3. The vacuum cleaner of claim 1, wherein the exhaust chamber is positioned adjacent the inner surface of the grate and adapted to convey a flow of air along at least a portion of the grate.

4. The vacuum cleaner of claim 1, wherein the flexible cover is adapted to diffuse the flow of air after it passes through the exhaust chamber.

5. The vacuum cleaner of claim 1, wherein the exhaust chamber comprises an air-impermeable surface adapted to form a portion of a bag chamber, one or more sealing surfaces surrounding the air-impermeable surface, and an exhaust chamber positioned adjacent the inner surface of the grate and adapted to convey a flow of air along at least a portion of the grate.

6. The vacuum cleaner of claim 5, wherein the exhaust chamber further comprises a portion adapted to cover a vacuum cleaner exhaust air opening and direct air from the exhaust air opening to the exhaust chamber.

7. The vacuum cleaner of claim 1, wherein the grate comprises a rigid panel, and the one or more air passages comprise a plurality of circular holes.

8. The vacuum cleaner of claim 1, wherein the grate comprises a separate part that is attached to the exhaust chamber.

9. The vacuum cleaner of claim 1, further comprising one or more tensioning members positioned adjacent the inner surface of the grate and adapted to hold the flexible cover in tension over the outer surface of the grate.

10. The vacuum cleaner of claim 9, wherein the flexible cover comprises a perimeter edge having a wire positioned therein, the wire being adapted to engage the one or more tensioning members.

11. The vacuum cleaner of claim 1, wherein the flexible cover extends over the entire outer surface of the grate.

12. The vacuum cleaner of claim 1, wherein the outer surface of the grate is convex and the inner surface of the grate is concave.

13. The vacuum cleaner of claim 1, further comprising a filter located in a generally airtight passage extending between the vacuum fan and the exhaust chamber, and adapted to filter the flow of air as it passes from the vacuum fan to the exhaust chamber.

14. The vacuum cleaner of claim 13, wherein the filter is removably mounted in a filter mount located in the generally airtight passage and held in place by a removable filter clamp, the filter clamp having one or more openings adapted to direct air passing through the filter towards the exhaust chamber.

15. The vacuum cleaner of claim 14, wherein the flexible cover is adapted to distribute the flow of air over a surface area substantially greater than the area of the filter mount.

16. The vacuum cleaner of claim 1, wherein the dirt receptacle comprises a vacuum bag chamber adapted to retain a vacuum filter bag therein.

17. The vacuum cleaner of claim 16, wherein the vacuum bag chamber comprises a removable cover, and at least a portion of the exhaust chamber and at least a portion of the grate are located on the removable cover.

18. The vacuum cleaner of claim 1, wherein the exhaust chamber further comprises:

a rigid frame having an outer perimeter and an opening therethrough.

19. A vacuum cleaner comprising:

a base adapted for movement over a surface to be cleaned;

a rear housing pivotally mounted to the base at a first end thereof, and having a hand grip at a second end thereof;

a dirt receptacle chamber located in the rear housing, the dirt receptacle chamber having a dirt receptacle chamber opening facing a first side of the rear housing;

a vacuum fan having an inlet and an outlet and being located in the rear housing adjacent the dirt receptacle chamber;

an intake air passage extending from the base, through the dirt receptacle chamber, and to the vacuum fan inlet;

an exhaust filter mount in fluid communication with the vacuum fan outlet, the exhaust filter mount comprising an open passage facing the first side of the rear housing;

an exhaust filter adapted to removably cover the exhaust filter mount;

an exhaust filter clamp adapted to removably cover the exhaust filter and hold the exhaust filter in place adjacent the exhaust filter mount;

a cover adapted to removably attach to the first side of the rear housing to overlie the exhaust filter clamp, exhaust filter, exhaust filter mount and dirt receptacle chamber opening, the cover comprising:

an exhaust chamber adapted to be in fluid communication with the exhaust filter when the cover is attached to the rear housing, a grate and/or a flexible cover enclosing the exhaust chamber and forming an exit from the exhaust chamber, the grate and/or the flexible cover having a surface area that is substantially greater than a surface area of the exhaust filter mount; and a surface adapted to enclose the dirt receptacle chamber opening when the cover is attached to the rear housing; and wherein the grate and/or the flexible cover comprises a planar portion that faces the exhaust filter mount, and wherein the exhaust filter clamp is adapted to direct air passing through the filter mount such that it does not pass in a straight line from the exhaust filter mount to the planar portion.

20. The vacuum cleaner of claim 19, wherein the cover comprises a grate and a flexible cover.

21. The vacuum cleaner of claim 19, wherein the dirt receptacle chamber comprises a bag chamber adapted to receive a filter bag therein.

* * * * *